US012668961B2

(12) United States Patent
Ahuja et al.

(10) Patent No.: US 12,668,961 B2
(45) Date of Patent: Jun. 30, 2026

(54) DRAIN STOPPER AND STRAINER

(71) Applicant: PF Waterworks LP, Houston, TX (US)

(72) Inventors: Sanjay Ahuja, Katy, TX (US); Harold Kent Beck, Copper Canyon, TX (US)

(73) Assignee: RectorSeal, LLC, Houston, TX (US)

( * ) Notice: Subject to any disclaimer, the term of this patent is extended or adjusted under 35 U.S.C. 154(b) by 805 days.

(21) Appl. No.: 17/988,950

(22) Filed: Nov. 17, 2022

(65) Prior Publication Data

US 2023/0078534 A1 Mar. 16, 2023

Related U.S. Application Data

(62) Division of application No. 16/558,262, filed on Sep. 2, 2019, now Pat. No. 11,519,161.

(51) Int. Cl.
*E03C 1/262* (2006.01)

(52) U.S. Cl.
CPC ..... *E03C 1/262* (2013.01)

(58) Field of Classification Search
CPC ..... E03C 1/262
USPC ..... 4/295
See application file for complete search history.

(56) References Cited

U.S. PATENT DOCUMENTS

| | | | | |
|---|---|---|---|---|
| 2,475,048 | A | 7/1949 | Pokras | |
| 3,665,526 | A * | 5/1972 | Hoffman | A47K 1/14 4/287 |
| 5,363,518 | A | 11/1994 | Mowery | |
| D402,355 | S | 12/1998 | Bahar et al. | |
| 6,067,669 | A | 5/2000 | Peterson et al. | |
| 6,276,000 | B1 | 8/2001 | Saman et al. | |
| 8,011,030 | B2 | 9/2011 | Li | |
| 8,813,272 | B2 | 8/2014 | Ball | |
| 9,453,329 | B2 | 9/2016 | Ball | |
| 9,499,962 | B2 | 11/2016 | Joseph | |
| 9,585,523 | B1 | 3/2017 | Brannan | |
| D783,134 | S | 4/2017 | Karnegie | |
| D785,767 | S | 5/2017 | Karnegie | |
| D794,759 | S | 8/2017 | Karnegie et al. | |
| 9,745,728 | B2 | 8/2017 | Beck et al. | |
| 9,790,673 | B2 | 10/2017 | Scott et al. | |
| 10,030,373 | B1 | 7/2018 | Batista | |
| 10,240,329 | B2 | 3/2019 | Beck et al. | |
| 10,301,803 | B2 | 5/2019 | Beck et al. | |
| 10,494,800 | B2 | 12/2019 | Ahuja et al. | |
| 11,162,251 | B2 | 11/2021 | Beck et al. | |
| 2004/0073992 | A1 | 4/2004 | Saman et al. | |
| 2013/0269100 | A1 | 10/2013 | Ball et al. | |
| 2017/0073949 | A1 | 3/2017 | Karnegie | |
| 2018/0274218 | A1* | 9/2018 | Karnegie | E03C 1/262 |
| 2019/0167043 | A1 | 6/2019 | Beck et al. | |
| 2020/0011038 | A1 | 1/2020 | Ahuja et al. | |

(Continued)

*Primary Examiner* — Lauren A Crane
(74) *Attorney, Agent, or Firm* — Dickinson Wright PLLC

(57) ABSTRACT

A drain stopper includes a cap, a seal and a strainer engaged with the cap, and a gripping element engaged with the strainer. The gripping element is resilient and has a generally tubular shape with longitudinal notches, which give it a segmented annular shape. A person grips and squeezes the gripping element to insert the stopper/strainer into a drain pipe, after which the gripping element expands and grips an inside wall of the drain pipe. The person pushes downwardly on the cap to place the stopper/strainer in a closed position and pulls up on the cap for an open position.

19 Claims, 17 Drawing Sheets

(56) References Cited

U.S. PATENT DOCUMENTS

| | | | |
|---|---|---|---|
| 2021/0207351 | A1 | 7/2021 | Ahuja et al. |
| 2022/0042292 | A1 | 2/2022 | Ahuja et al. |

* cited by examiner

FIG. 10
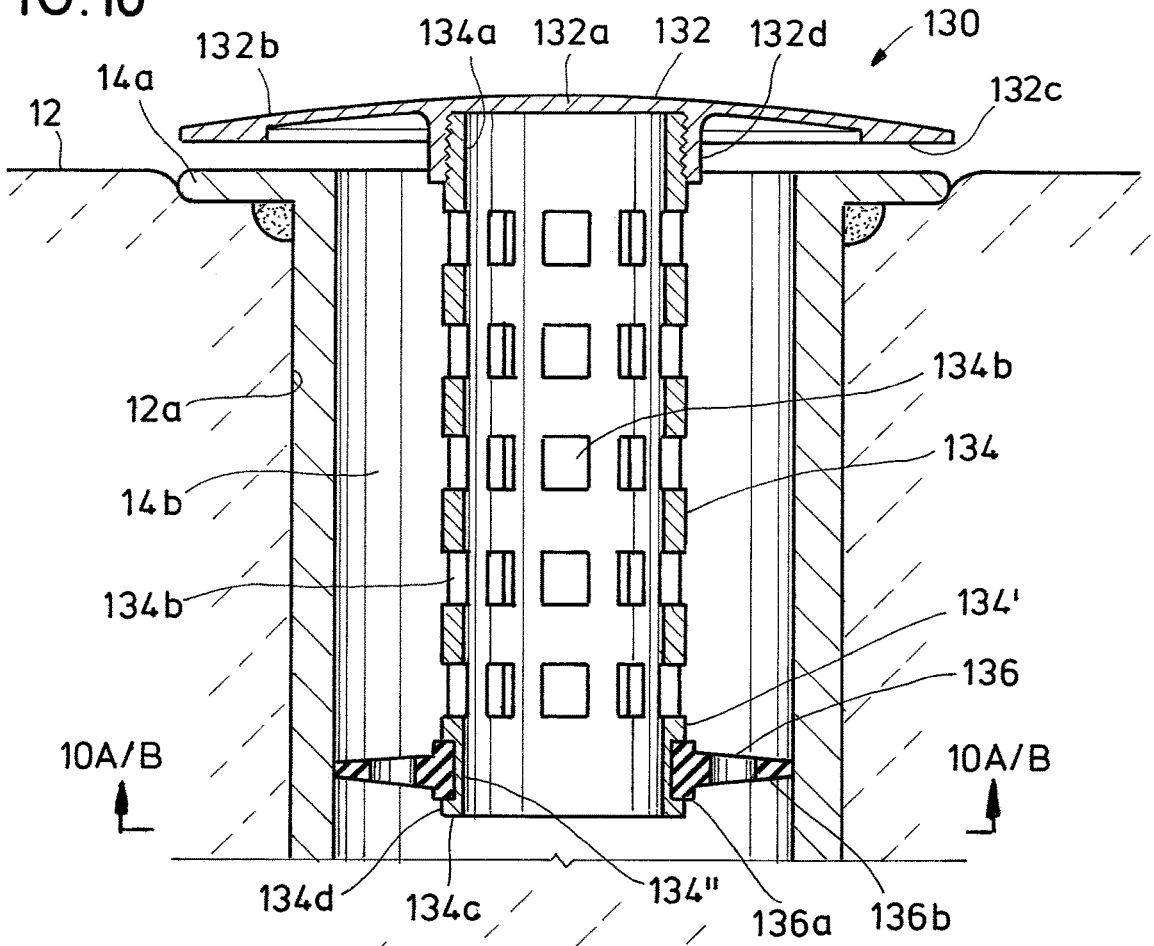
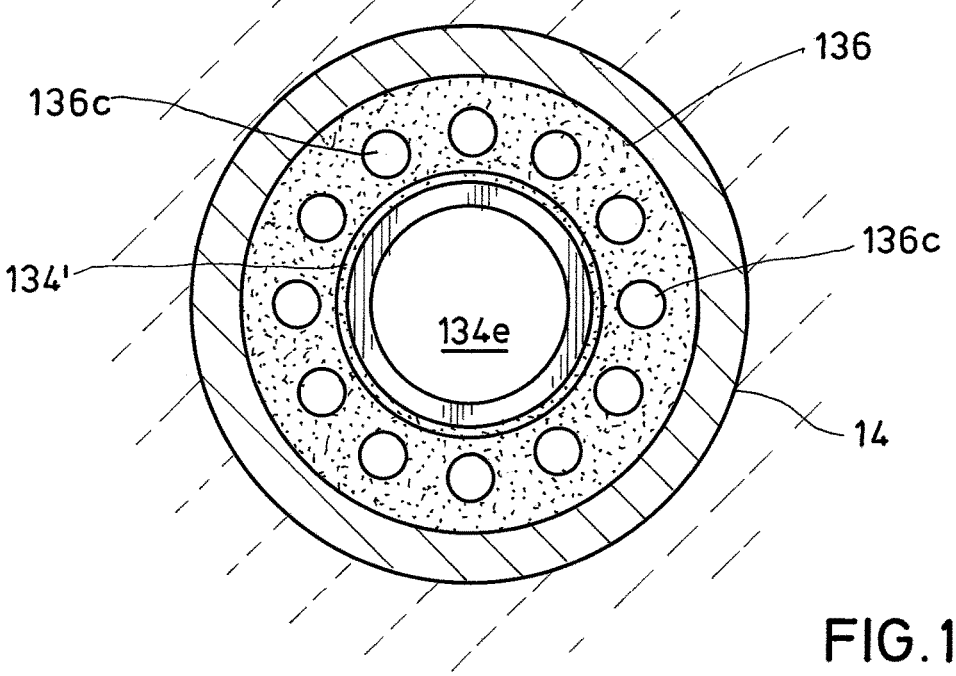
FIG. 10A 170
172
152
154a
150f
152a
156c'
156c
156
150e
150m
13D
160
13C
154b
158a
158
154
150g
156d
156a
150e
13D
13C
154f
158
158c
154d
154c
150g
150f
156c'
156d
154
154e
150n
158
154b
158c
154d
152a
150f
156c
154c
156b
160
154f
154e
150g
150m
154
154c
156
156d

DRAIN STOPPER AND STRAINER

CROSS REFERENCE TO RELATED APPLICATIONS

This is a division of U.S. patent application Ser. No. 16/558,262 filed on Sep. 2, 2019, now U.S. Pat. No. 11,519,161, which is a continuation in part of U.S. patent application Ser. No. 15/913,452 filed on Mar. 6, 2018, now U.S. Pat. No. 11,517,155, each of which is incorporated by reference.

BACKGROUND OF THE INVENTION

1. Field of the Invention

The present invention pertains to a drain stopper for drains from sinks and bathtubs. A drain stopper has a strainer and a gripping element that uses friction between the gripping element and an inside wall of a drain pipe to hold the stopper in an open or closed position in one embodiment. In another embodiment, a drain stopper has an open-close mechanism, means for holding the open-close mechanism in a drain pipe and, preferably, a strainer, more particularly, where the means is a set of prongs or an annular flange that rests on a drain flange.

2. Description of the Related Art

In a lavatory or bathroom sink or basin equipped with a supply of running water for washing oneself, a pop-up drain assembly allows one to retain water in the sink or basin and then release the water to flow by gravity downwardly through a drain pipe. The sink or basin has an opening at a lowermost point, and a typical pop-up drain assembly comprises a drain conduit sealingly fastened to the sink or basin within the opening, where a drain flange surrounds an upper side of the opening. A drain stopper is received in the drain conduit for sealing the opening and retaining water in the sink or basin. A pivot rod protrudes into the drain conduit and engages a bottom portion of the drain stopper. A lift rod is connected to the pivot rod. One can pull the lift rod up to pull the drain stopper down for sealing the opening in the bottom of the sink or basin for retaining water, and one can push the lift rod down to raise the drain stopper, which unseals the drain stopper and allows water to drain from the sink or basin. U.S. Pat. No. 4,807,306, issued to Hayman et al., illustrates quite well the components in a typical prior art pop-up drain assembly and is incorporated by reference for all purposes.

U.S. Pat. No. 5,363,518, issued to Mowery, recognized that one may wish to change the appearance of a pop-up drain assembly. An existing finish may have become worn, damaged, tarnished or discolored, or one may merely wish to change the color of the finish. Effort and expense is required to completely replace the pop-up drain assembly. Mowery describes a pop-up drain stopper with a decorative cap that can be used in an existing drain conduit for changing or improving the appearance of a pop-up drain assembly. However, there continues to be a need for a simple and cost-effective means for changing or improving the appearance of a pop-up drain assembly and for changing or improving the appearance of a drain assembly in a bathtub. There also continues to be a need for a strainer in a drain pipe to catch hair, debris and objects.

As for this continuation-in-part (CIP) application, the following patents have issued and a patent application was filed on combined drain stoppers and strainers, each of which is incorporated by reference: U.S. Pat. No. 10,030,373, issued to Batista on Jul. 24, 2018; U.S. Pat. No. 9,790,673, issued to Scott et al. on Oct. 17, 2017; U.S. Pat. No. 9,499,962, issued to Joseph on Nov. 22, 2016; U.S. Pat. No. 6,276,000, issued to Saman et al. on Aug. 21, 2001; and D402,355, issued to Bahar et al. on Dec. 8, 1998; and patent application Ser. No. 10/271,676 filed by Saman et al. on Oct. 16, 2002, which was published as Pub. No. 2004/0073992 A1 on Apr. 22, 2004 A need remains for a combined drain stopper and strainer, although a number of combined drain stoppers and strainers have been disclosed.

SUMMARY OF THE INVENTION

The CIP invention provides a drain stopper and strainer for a drain opening, such as in a bathroom or kitchen sink or a bathtub, where a drain pipe that has a drain flange is sealed in the drain opening. The drain stopper and strainer includes a cap; a seal engaged with the cap for providing a seal with the drain flange or the drain pipe; a strainer having upper and lower ends, wherein the upper end is engaged with the cap directly or indirectly; and a gripping element attached to or formed integral with the lower end of the strainer. The gripping element has a generally tubular shape, such as cylindrical or conical, and has opposing top and bottom ends. The top end is attached to or formed integral with the lower end of the strainer. The gripping element has longitudinal notches so as to have a segmented annular shape. The gripping element is resilient and sized to grip an inside wall of the drain pipe. A person compresses or squeezes segments of the gripping element closer together to insert it into the drain opening and drain pipe, and after release, the segments of the gripping element spring radially outwardly to provide a friction grip with an inside wall of the drain pipe. The person can hold the cap and slide the stopper down to a closed position and up to an open position. Drain water passes through openings in the strainer, which tends to remove hair, debris and objects from the drain water. The stopper/strainer can be pulled out of the drain opening to clean the strainer and then be reinserted.

The CIP invention also provides a drain stopper for a drain pipe having a drain flange that includes: an open-close mechanism having a length and opposing upper and lower ends; a cap engaged with the upper end of the open-close mechanism; a seal engaged with the cap for providing a seal with the drain flange; and means for holding the open-close mechanism inside the drain pipe. The drain stopper preferably includes a strainer, which preferably provides the means for holding the mechanism. Means include two or more prongs extending from the strainer or an annular flange on an upper end of the strainer, where the prongs or the annular flange rest on the drain flange. The open-close mechanism can be put into and pulled out of the drain pipe without any assembly or disassembly required to do so and does not rely on a support within the drain pipe such as a pivot rod or cross-bars. A person moves the cap such as by pushing or turning to cause the open-close mechanism to move the seal between open and closed positions.

The present invention provides in one embodiment a drain flange cover. Water in a sink or bathtub drains into a drain pipe through a drain opening. The drain pipe has a drain flange above and surrounding the drain opening, which is typically visible and which typically matches the finish of an associated faucet. One may wish to change the appearance of the drain flange, such as for a change in the finish or because the finish no longer looks good, but that requires removal and replacement of at least the drain flange. The drain flange cover can be used to cover and hide the drain flange rather than removing and replacing the drain flange. The drain flange cover may also include a strainer for removing hair, debris and objects out of the water as it drains from the sink or bathtub.

A drain flange cover and strainer in one embodiment of the invention includes a cap, a perforated tubular shaft depending from an underside of the cap, a gasket holder on the lower end of the shaft and a gasket on the gasket holder. The cap has an upper and outer surface and an opposing underside. A perforated tubular shaft projects downwardly from the underside of the cap. An upper end of the shaft is attached to or formed integral with the cap, and an opposing lower end is open or has openings through which water can flow. The perforated tubular shaft serves as the strainer and has openings sized and designed to filter out hair, debris and objects while allowing water to pass through the openings into the interior of the perforated tubular shaft. The gasket holder is attached to or formed integral with the lower end of the shaft and is preferably a disk that obstructs the flow of water through the drain pipe, except it preferably has openings for the flow of water downwardly from the interior of the tubular shaft. A gasket is engaged with the gasket holder and projects radially with respect to the longitudinal axis of the tubular shaft. The gasket is preferably sized and designed to touch or contact an inside wall of the drain pipe. The gasket preferably seals an annular space between the inside wall of the drain pipe and the perimeter of the disk, but may alternatively have holes in its body or notches in its perimeter, thereby enabling the gasket to also serve as a strainer. The cap preferably comprises a dome-shaped structure that is sized and designed to cover and hide the drain flange. The diameter of the cap is preferably at least 0.50 inch and more preferably at least 1.0 inch greater than the diameter of the gasket. The cap may have a low or small radius of curvature so that it does not protrude substantially above the drain flange. The cap, the perforated tubular shaft and the gasket holder are preferably rigid and are preferably made of a polymeric material.

A drain stopper for a bathtub or sink is another embodiment of the present invention. The drain stopper includes an open-close mechanism having upper and lower ends, a cap engaged with the upper end of the open-close mechanism, a seal engaged with the cap for holding water in the bathtub or sink, a disk engaged with the lower end of the open-close mechanism, and a strainer surrounding the open-close mechanism. The strainer rests on or is formed integral with or is attached to the disk. The disk preferably includes a gasket at its perimeter, which preferably seals the disk against the inside wall of a drain pipe. The strainer has an inner space defined in part by an inner surface of the strainer. The strainer has a plurality of openings through which water can flow from outside the strainer to the inner space inside the strainer. The disk has openings through which the water can drain downwardly from the inner space inside the strainer. The open-close mechanism is typically a push-push mechanism or a lift-and-lock mechanism or a lift-and-turn mechanism. The cap is preferably sized and designed to cover a drain flange and preferably has a diameter greater than the diameter of the seal, preferably at least 0.5 inch greater.

BRIEF DESCRIPTION OF THE DRAWINGS

A better understanding of the invention can be obtained when the detailed description of exemplary embodiments set forth below is considered in conjunction with the attached drawings in which:

FIG. 10 is a side elevation in cross-section of a drain flange cover having a perforated tubular shaft as a strainer basket, according to the present invention.

FIG. 10A is a cross-section of the drain flange cover of FIG. 10 as seen along the line 10A-10A.

DETAILED DESCRIPTION OF THE EXEMPLARY EMBODIMENTS

A sink and a bathtub each have a drain opening through which water can drain out of the sink or the bathtub. A drain pipe fits down through the drain opening in the sink or bathtub. The drain pipe typically has a threaded tubular portion extending essentially throughout its full length and a drain flange extends radially outwardly on a top end. The drain flange stays above the drain opening. A gasket or plumber's putty is used to provide a seal between an upper surface of the sink or bathtub and a lower surface of the drain flange. A flexible gasket and a washer are placed around a bottom portion of the drain pipe and then pressed tightly against a bottom surface of the sink or bathtub with a threaded nut.

For a sink, a drain body is threaded onto a lower end of the drain pipe. A drain stopper is received in the drain pipe for trapping water in the sink. In a pop-up drain assembly for a sink, the stopper has a cap and a gasket on an upper end for sealing against the drain flange and an elongate body that extends downwardly into the drain body. The drain body has a pivot rod port, and a threaded tubular stub projects radially outwardly from the drain body. A pivot rod seal is received in the stub. A pivot rod has a pivot ball sealingly received on the pivot rod. The pivot rod is received in the stub such that a portion of the pivot rod is inside the drain body, and the pivot ball rests against pivot rod seal. The pivot rod engages a lower end of the drain stopper for lifting the stopper up and pulling it down, thereby opening and closing the drain stopper. A pivot rod cap is threaded onto the stub to seal the pivot ball against the pivot rod seal. The pivot rod extends outwardly from the stub, and the pivot rod is in a somewhat horizontal position. A control rod has an upper end above the sink and is used to open and close the drain stopper. The control rod is in a generally vertical position and passes downwardly from above the sink through a port. A connector device is used to connect the generally vertical control rod to the generally horizontal pivot rod. One can push the control rod down to open the drain stopper and pull the control rod up to close the stopper.

A bathtub does not have the same type of pop-up drain assembly, but does have a drain pipe that has a drain flange sealed around a drain opening in the bathtub. The drain flange is visible in a sink and in a bathtub. If the drain flange for a sink or bathtub becomes worn, tarnished or damaged, or if one wants to change the color scheme or finish color for the drain flange, then a considerable effort and expense is required to change out the drain flange. The present invention concerns covering and hiding the drain flange in a sink or bathtub so that the appearance of a sink or bathtub drain can be improved or changed, without it being necessary to remove and replace the drain flange.

Figure 1A:
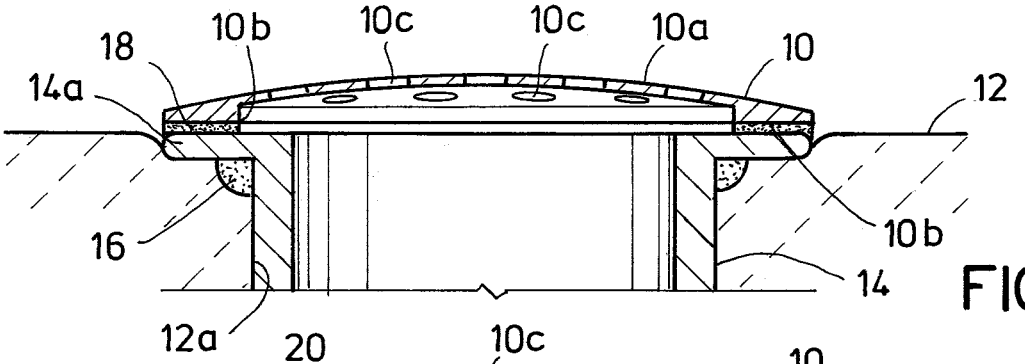
FIG. 1A is a side elevation in cross-section of a drain flange cover, according to the present invention.

Turning now to the present invention, FIG. 1A is a side elevation in cross-section of a drain flange cover 10, according to the present invention. A sink or bathtub 12 has a drain opening 12*a*. A drain pipe 14 is received in the opening 12*a* and has a drain flange 14*a* that extends radially outwardly from the longitudinal axis of the drain pipe 14 and rests on an upper surface of the sink or bathtub 12. A plumber's putty or gasket 16 seals a lower surface of the drain flange to the upper surface of the sink or bathtub 12 around the drain opening 12*a*. The drain flange cover 10 has an upper dome-shaped surface 10*a* that is convex with respect to the longitudinal axis of the drain pipe 14. The dome shape is not an essential feature, and drain flange cover 10 can have a flat, planar shape. A washer-shaped annular ring of glue 18 is bonded to and sealed with an upper surface of the drain flange 14*a*. Drain flange cover 10 has a washer-shaped annular lower surface 10*b* adjacent to its perimeter or circumference, and glue 18 is also bonded to and sealed with the annular lower surface 10*b*. Drain flange cover 10 has a diameter that is equal to or greater than the diameter of the drain flange 14*a*, preferably 5 to 15 percent and more preferably about 10 percent greater than the diameter of the drain flange 14*a*. Drain flange cover 10 is a strainer in this embodiment and has holes or openings 10*c* that allow water to drain out of the sink or bathtub through drain flange cover 10. Drain flange cover 10 does not open or close in this embodiment and is instead fastened to the drain flange 14*a* by glue or adhesive 18. Drain flange cover 10 can be made of a metal and have a finish such as chrome, polished chrome, brushed chrome, bronze, oil-rubbed bronze, polished bronze, brushed nickel, polished nickel, polished brass, satin brass, satin bronze, copper, matte black and white. Drain flange cover 10 can be made of a plastic or polymeric material. A sheet of material (not shown) can cover drain flange cover 10 and provide a desired appearance. For example, a thin sheet of material having an outer surface in one of the finishes noted above can cover the upper surface of drain flange cover 10 and be wrapped under the annular lower surface 10*b*. The sheet of material can be crimped along an edge under the annular lower surface 10*b* or can be glued onto the drain flange cover 10 or both. Drain flange cover 10 can be made and sold in a variety of colors and plumbing fixture finishes, such as noted above, preferably with the layer of glue 18 and a removable film covering the glue 18 for a peel-and-stick installation on the drain flange 14. Drain flange cover 10 can have any design, such as a sports emblem or cartoon character, or color, such as red or blue, in addition to the typical plumbing finishes noted above. Drain flange cover 10 can be plated instead of having a sheet of material as a separate component. The phrase sheet of material will generally include plating and designs and colors that are made integral with the drain flange cover.

Figure 1B:
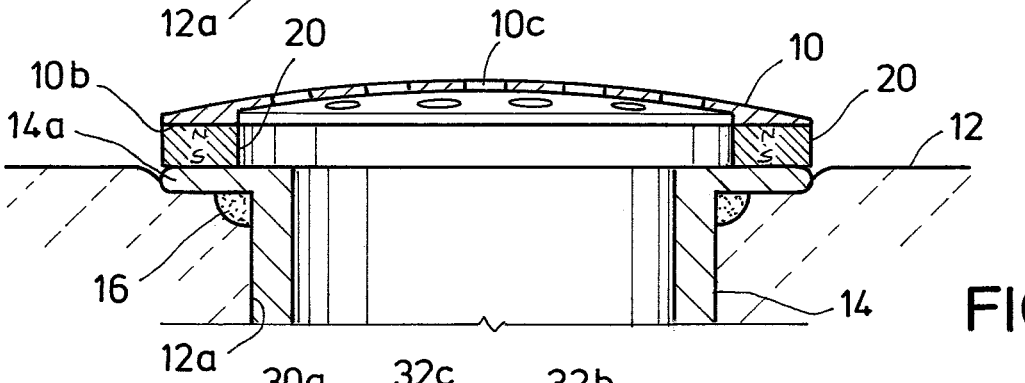
FIG. 1B is a side elevation in cross-section of a drain flange cover, according to the present invention.

FIG. 1B is also a side elevation in cross-section of the drain flange cover 10 in the sink or bathtub 12, which has the drain opening 12*a*. A washer-shaped annular ring 20 is a magnet for removably fastening the drain flange cover 10 to the drain flange 14*a*. Magnet 20 can be incorporated into or can be bonded to or adhered to the washer-shaped annular lower surface 10*b* of the drain flange cover 10, or magnet 20 can be a separate piece that is at least magnetically attracted to both the drain flange cover 10 and the drain flange 14*a*. Magnet 20 is useful with drain flanges that are attracted to a magnet. Magnet 20 could be bonded or adhered to one of the drain flange cover 10 or the drain flange 14*a* and magnetically attracted to the other. For example, magnet 20 could be made and sold as a separate piece with a peel-and-stick adhesive layer for being attached to the drain flange 14*a*, and the drain flange cover 10 could be magnetically and removably attachable to the magnet 20. In either or any case, the drain flange cover 10 can be made and sold in a variety of plumbing finishes and other colors and designs, which one can purchase and use to hide and cover the drain flange 14*a*, thereby changing the appearance of the sink or bathtub drain.

FIGS. 1A and 1B describe in one embodiment an article of manufacture (a drain flange cover) for covering a drain flange surrounding a drain opening in a sink or bathtub, which comprises: a sheet of material having a circular shape, a diameter suitable for covering the drain flange, a central portion, a perimeter portion along the perimeter of the sheet of material that surrounds the central portion, a top side, a bottom side and a plurality of holes passing through the sheet of material from the top side to the bottom side that make the sheet suitable for use as a strainer; and a layer of glue or a magnet on the bottom side of the sheet of material on the perimeter portion, where there is no glue on the top side of the sheet or on the bottom side within the central portion. The diameter of the article is preferably between one and three inches. The layer of glue or the magnet has an annular shape. The article of manufacture does not have a central, longitudinal shaft extending transverse to the sheet of material.

Figure 2A:
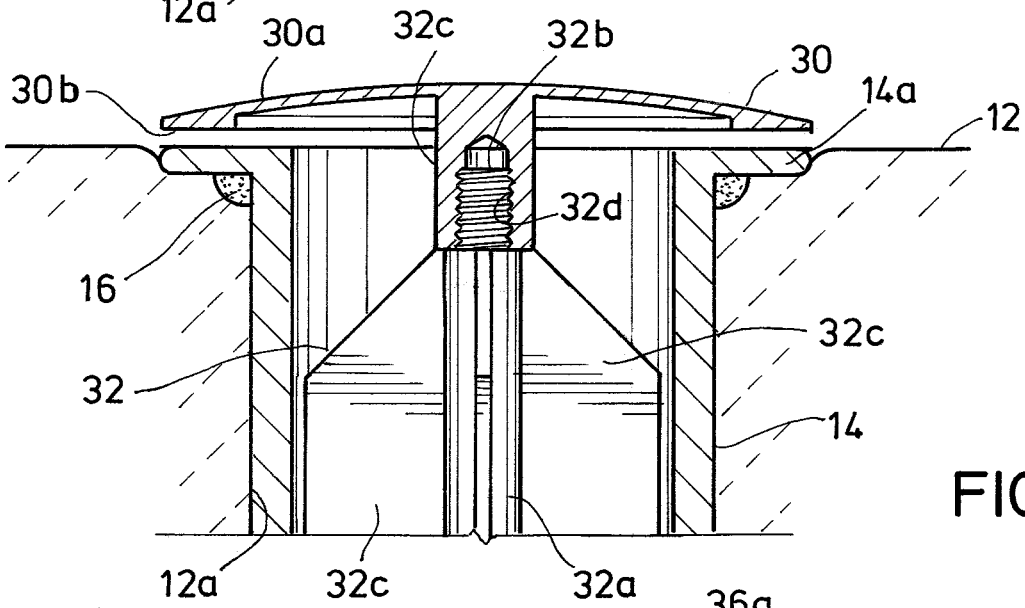
FIG. 2A is a side elevation in cross-section of a drain flange cover, according to the present invention.

FIG. 2A is a side elevation in cross-section of a drain flange cover 30 in the sink or bathtub 12, which has the drain opening 12*a* and the drain pipe 14 and drain flange 14*a*. A drain stopper 32 is received in the drain pipe 14 and has a central longitudinal shaft 32*a*, which terminates as a male-threaded stud 32*b* at its upper end, and centralizing fins 32*c*. Drain flange cover 30 has a dome-shaped upper and outer surface 30*a* and a washer-shaped annular flat ring 30*b* on a lower side along the perimeter. A tubular stub 32*c* with female threads 32*d* projects from the lower side of the drain flange cover 30 and is threaded onto the upper end 32*b* of the stopper 32. Drain flange cover 30 covers and hides drain flange 14*a*. The present inventors disclose and describe various stoppers and other information in their U.S. patent application Ser. Nos. 15/584,027, 15/584,030 and 15/584,032, which are available as Publication Nos. 2017/0260724 A1, 2017/0314244 A1 and 2017/0314245 A1, and each is incorporated by reference.

Figure 2B:
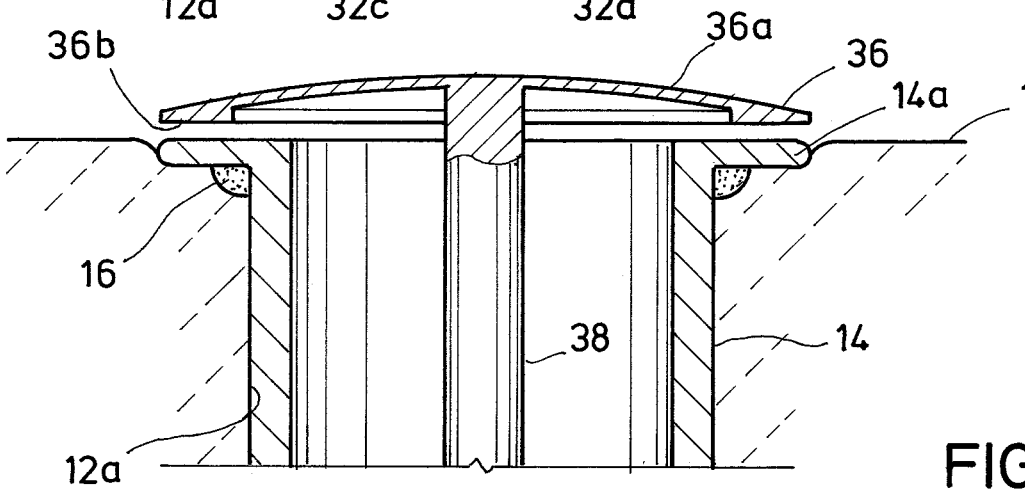
FIG. 2B is a side elevation in cross-section of a drain flange cover, according to the present invention.

FIG. 2B is a side elevation in cross-section of a drain flange cover 36 in the sink or bathtub 12, which has the drain opening 12*a* and the drain pipe 14 and drain flange 14*a*. Drain flange cover 36 has a dome-shaped upper and outer surface 36*a* and a washer-shaped annular flat ring 36*b* on a lower side along its perimeter. A central, longitudinal shaft 38 projects perpendicularly from the lower side of the drain flange cover 36. Shaft 38 may or may not be part of a drain stopper that has centralizing flanges or fins and may or may not have means for connecting to a pivot rod. The drain flange cover 30 is fixed to or formed integral with the shaft 38. Drain flange cover 36 covers and hides drain flange 14*a*.

Figure 3A:
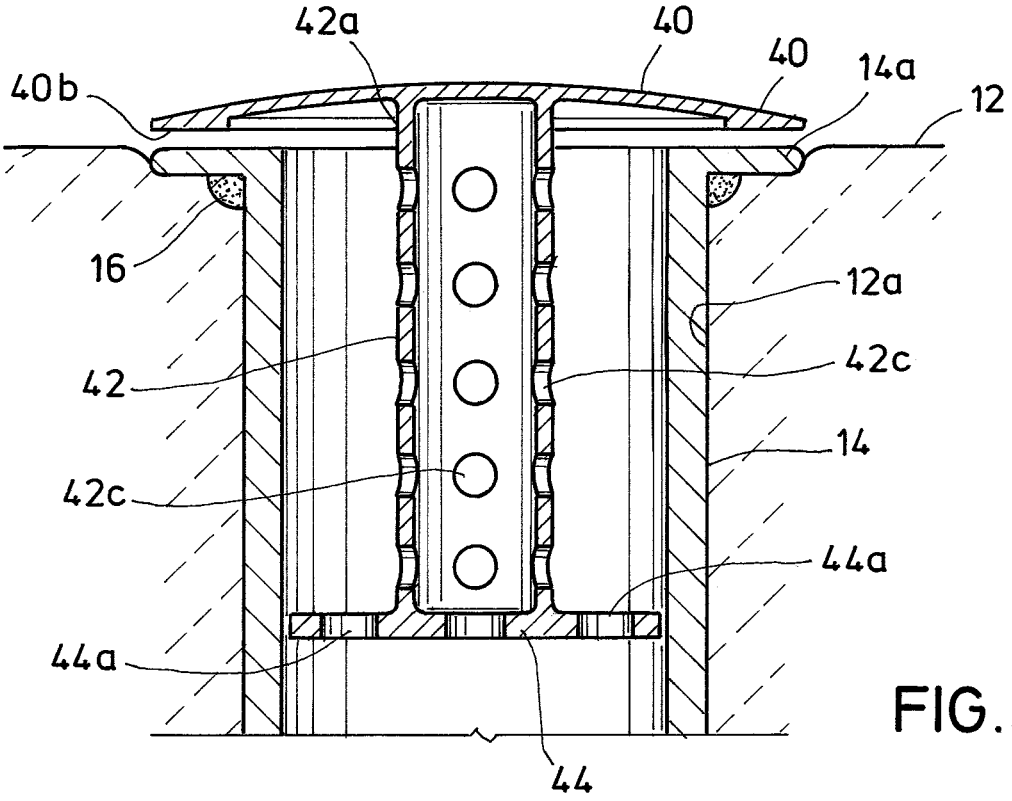
FIG. 3A is a side elevation in cross-section of a drain flange cover, according to the present invention.

FIG. 3A is a side elevation in cross-section of a drain flange cover 40 in the sink or bathtub 12, which has the drain opening 12*a* and the drain pipe 14 and drain flange 14*a*. Each of the drain flange covers described herein has a diameter that is equal to or greater than the diameter of the drain flange 14*a* and is preferably 1 to 25 percent and more preferably about 5 to 15 percent greater than the diameter of the drain flange 14*a*. Each of the drain flange covers described herein covers and hides drain flange 14*a*, which is one use for the drain flange covers. Drain flange cover 40 also serves as a strainer for removing hair, debris and objects from water that drains from the sink or bathtub 12. Drain flange cover 40 has a dome-shaped upper and outer surface 40*a* and a washer-shaped annular flat ring 40*b* on a lower side along its perimeter. A central, longitudinal, tubular shaft 42 projects perpendicularly from and has an upper end 42*a* attached to or formed integral with the lower side of the drain flange cover 40. A disc 44 is attached to a lower end 42*b* of the tubular shaft 42. Tubular shaft 42 is a hollow cylinder having a perforated wall. Numerous openings 42*c* in the tubular shaft 42 comprise the perforations and allow water to drain into the inside of the tubular shaft 42, while straining out some, most or all hair, debris and objects in the water. The disc 44 is also perforated and has a plurality of openings 44*a*. Disc 44 has opposing planar surface, like the planar surfaces of a ring-shaped, flat washer, which are perpendicular to the longitudinal axis of the tubular shaft 42. Disc 44 preferably has an opening aligned with the central open portion of the tubular shaft 42 so that it does not impede the flow of water out of the center of the tubular shaft 42 and into the drain pipe 14. Disc 44 can be sized to fit tightly, but movably, within drain pipe 14. One option includes an O-ring seal around the perimeter or circumference of the disc 44 for sealing against the inside wall of drain pipe 14. Another type of seal or gasket can be fixed to the disc 44. A tight fit between the disc 44 or an O-ring or gasket on the disc 44 and the inside wall of the drain pipe 14 can ensure that drain flange cover remains spaced above the drain flange 14*a* so that water can drain readily from the sing or bathtub 12. Standoffs or feet (not shown) can be included between the lower surface 40*b* of the drain flange cover 40 and the upper surface of the drain flange 14*a* for spacing the drain flange cover 40 from the drain flange 14*a* so that water can drain through the space provided. The standoffs or feet can be attached to or formed integral with the drain flange cover 40. Centralizer elements (not shown) can be added to the underside of the drain flange cover 40 or to the outside of the tubular shaft 42 for holding and maintaining the tubular shaft 42 in the center of the drain pipe 14, thereby ensuring that the drain flange cover 40 always covers and hides the drain flange 14*a*.

Figure 3B:
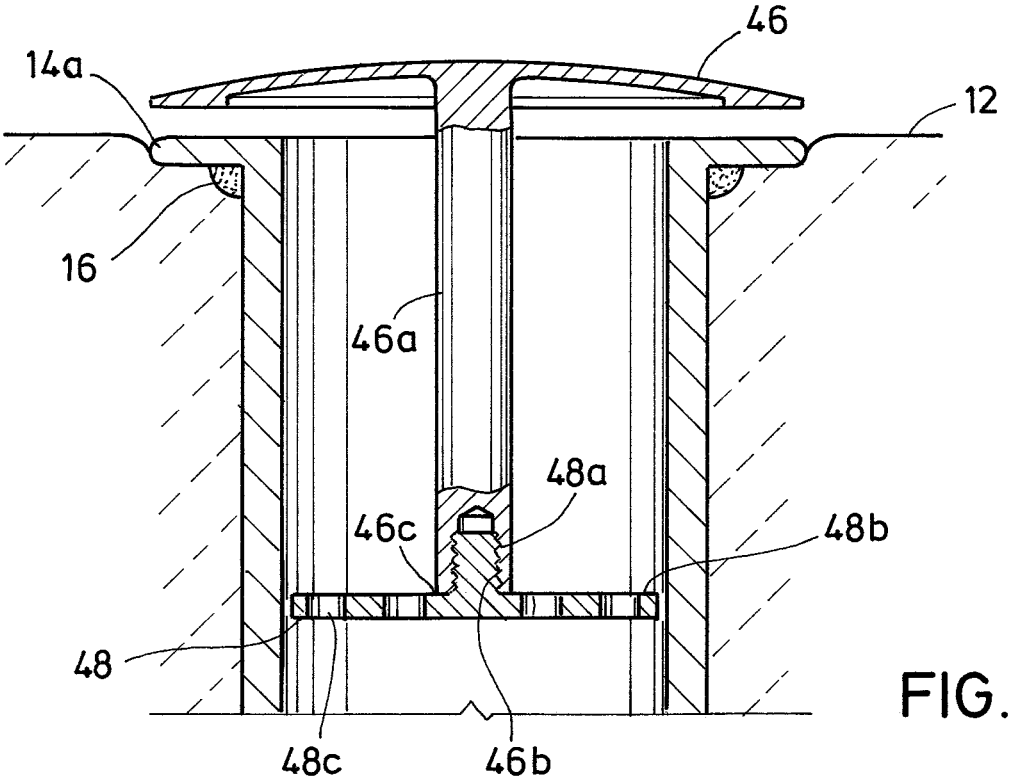
FIG. 3B is a side elevation in cross-section of a drain flange cover, according to the present invention.

FIG. 3B is a side elevation in cross-section of a drain flange cover 46 in the sink or bathtub 12, which has the drain opening 12*a* and the drain pipe 14 and drain flange 14*a*. Rather than having a tubular shaft such as shaft 42 in FIG. 3A, a solid, central, longitudinal shaft 46*a* projects perpendicularly from the underside of the drain flange cover 46. Shaft 46*a* has a central, longitudinal, threaded bore 46*b* at a lower end 46*c*. A perforated, circular disc 48 has a threaded stud 48*a* that projects perpendicularly from an upper, planar surface 48*b* of the disc 48. The disc 48 is fastened to the lower end 46*c* of the shaft 46 by screwing the stud 48*a* into the threaded bore 46*b*. A plurality of openings 48*c* provide the perforations for disc 48. Water can flow through the openings 48*c*, but hair, debris and objects tend to be retained upper surface 48*b* of the disc 48. The disc 48 serves as a strainer. Standoffs and centralizers such as described for FIG. 3A can also be used with the drain flange cover 46 in FIG. 3B. Drain flange cover 46 preferably always covers and hides the drain flange 14*a*.

FIGS. 3A and 3B describe a drain flange cover that comprises: a dome-shaped structure having an upper surface that has a curvature of a dome and an opposing lower surface, where the dome-shaped structure is sized and designed to cover and hide the drain flange; a shaft having an upper end attached to or formed integral with the dome-shaped structure and an opposing lower end, where the shaft projects perpendicular from the lower surface of the dome-shaped structure; and a disc attached to or formed integral with the lower end of the shaft, wherein the shaft projects perpendicular from the disc, where the disc is circular and has a diameter that is slightly less than the diameter of the drain opening, and where the disc has openings through which water can pass and structural elements for screening hair and debris out of the water. An O-ring is preferably included around the circumference of the disc. The disc is preferably sized and designed to seal against the inside wall of the drain pipe. In one embodiment, the shaft is a tube having a perforated tube wall so water can drain through the perforated tube wall for screening hair and debris out of the water. A sheet of a material preferably covers the upper surface of the dome-shaped structure.

Figure 4A:
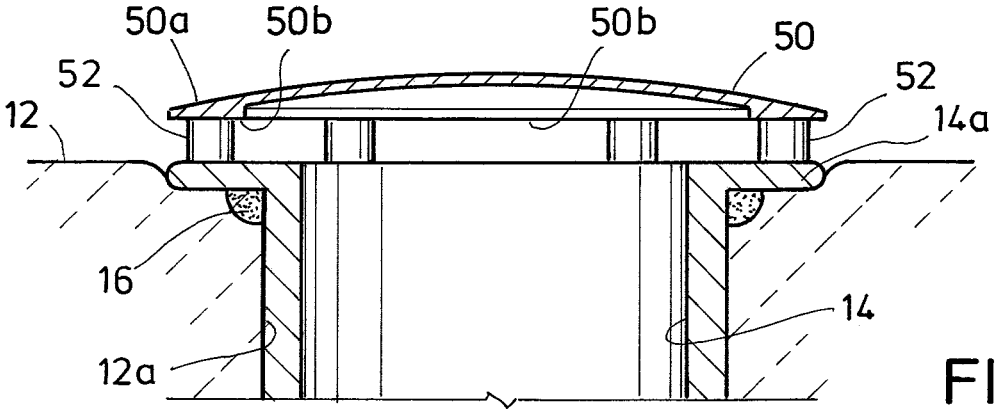
FIG. 4A is a side elevation in cross-section of a drain flange cover, according to the present invention.

FIG. 4A is a side elevation in cross-section of a drain flange cover 50 in the sink or bathtub 12, which has the drain opening 12*a* and the drain pipe 14 and drain flange 14*a*. The drain flange cover 50 has an upper dome-shaped surface 50*a* that is convex with respect to the longitudinal axis of the drain pipe 14. The drain flange cover 50 has a diameter that is equal to or greater than the diameter of the drain flange 14*a* so that the drain flange cover 50 covers and hides the drain flange 14*a*. Standoffs 52 are between a lower surface 50*b* of the drain flange cover 50 and the upper surface of the drain flange 14*a* for spacing the drain flange cover 50 from the drain flange 14*a* so that water can drain through the space provided. The standoffs 52 can be attached to or formed integral with the drain flange cover 50. A drain flange cover 54 in FIG. 4B is similar to the drain flange cover 50, except it has a set of standoffs 56 that include centering legs 56*a*, which serve as centralizing elements for keeping the drain flange cover 54 centered over the drain pipe 14 so that the drain flange 14*a* remains covered by the drain flange cover 54.

Figure 4B:
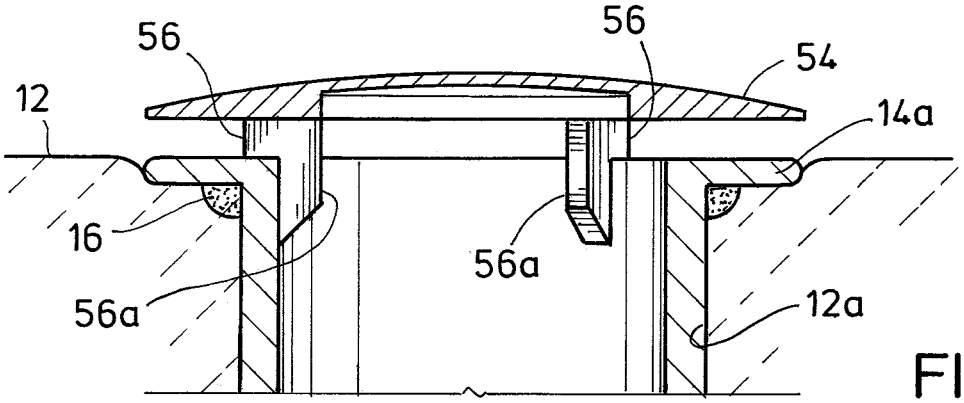
FIG. 4B is a side elevation in cross-section of a drain flange cover, according to the present invention.

FIGS. 4A and 4B describe a drain flange cover for covering a drain flange around a drain opening in a sink or bathtub, which comprises: a dome-shaped structure having an upper surface that has a curvature of a dome and an opposing lower surface, where the dome-shaped structure has a diameter of between one and three inches and is sized to cover and hide the drain flange; and two to four or so standoffs that project from the lower surface of the dome-shaped structure that are designed and sized to rest on the drain flange and space the dome-shaped structure away from the drain flange so that water can flow out of the sink or bathtub between the lower surface of the dome-shaped structure and the drain flange around the stand-offs and into the drain opening. The standoffs space the lower surface from the drain flange between 1/16 and ½ of an inch or between 3-5 mm and 1-2 cm. An adhesive or a magnet can be used for fastening the standoffs to the drain flange. A decorative sheet of material is preferably included for covering the upper surface of the dome-shaped structure. The sheet of material is metallic in one embodiment and is bent to lap under the lower surface for fastening the sheet of material to the dome-shaped structure. The sheet can be glued to the upper surface of the dome-shaped structure. The dome-shaped structure preferably comprises a plastic or polymeric article of manufacture, which is preferably a solid at the upper surface and preferably has a web and hollow-cell structure at its lower surface.

Figure 5A:
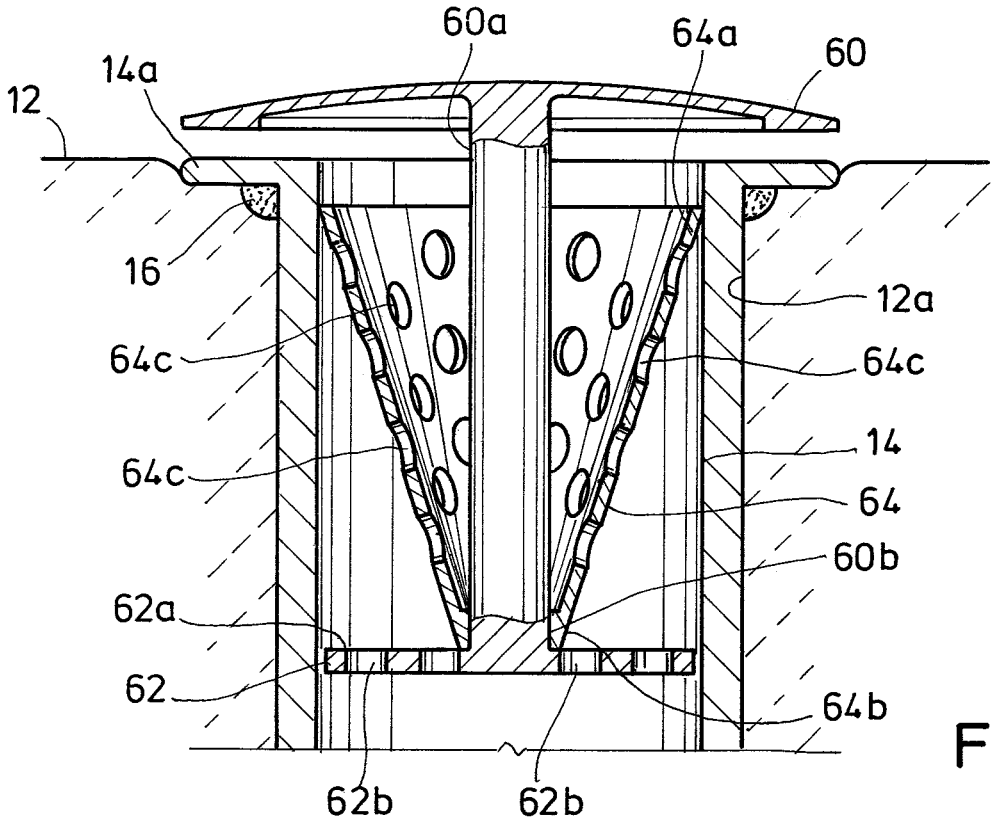
FIG. 5A is a side elevation in cross-section of a drain flange cover having a longitudinal shaft, a disk on the lower end of the shaft and a strainer basket surrounding the shaft, according to the present invention.

FIG. 5A is a side elevation in cross-section of a drain flange cover 60 in the sink or bathtub 12, which has the drain opening 12*a* and the drain pipe 14 and drain flange 14*a*. A solid, central, longitudinal shaft 60*a* projects perpendicularly from the underside of the drain flange cover 60. Rather than shaft 60*a* having a central, longitudinal, threaded bore at a lower end 60*b*, a perforated, circular disc 62 has an upper, planar surface 62*a* and is fixed to or formed integral with the lower end 60*b* of the shaft 60*a*. Disc 62 has numerous openings 62*b*, which provide the perforations. Drain flange cover 60 is similar to drain flange cover 46 in FIG. 3B, except a strainer basket 64 surrounds the shaft 60*a* and has a lower end that rests on upper surface 62*a* of the disc 62. Strainer basket 64 has the shape of a regular funnel with a large diameter at an upper end 64*a*, which fits snugly inside the drain pipe 14, and a relatively smaller diameter at a lower end 64*b*, which fits snugly around the lower end 60*b* of the shaft 60*a*. Strainer 64 has a plurality of holes 64*c*, which strain water that flows into the open upper end 64*a* and out through the holes 64*c*, catching hair, debris and objects inside the strainer 64. An O-ring seal or a gasket can be placed around the perimeter of the disc 62 for sealing against the inside wall of the drain pipe 14. The disc 62 serves as a centralizer at the lower end of the drain flange cover 60, and the upper end 64*a* of the strainer basket 64 serves as a centralizer for the upper portion of the drain flange cover 60.

Figure 5B:
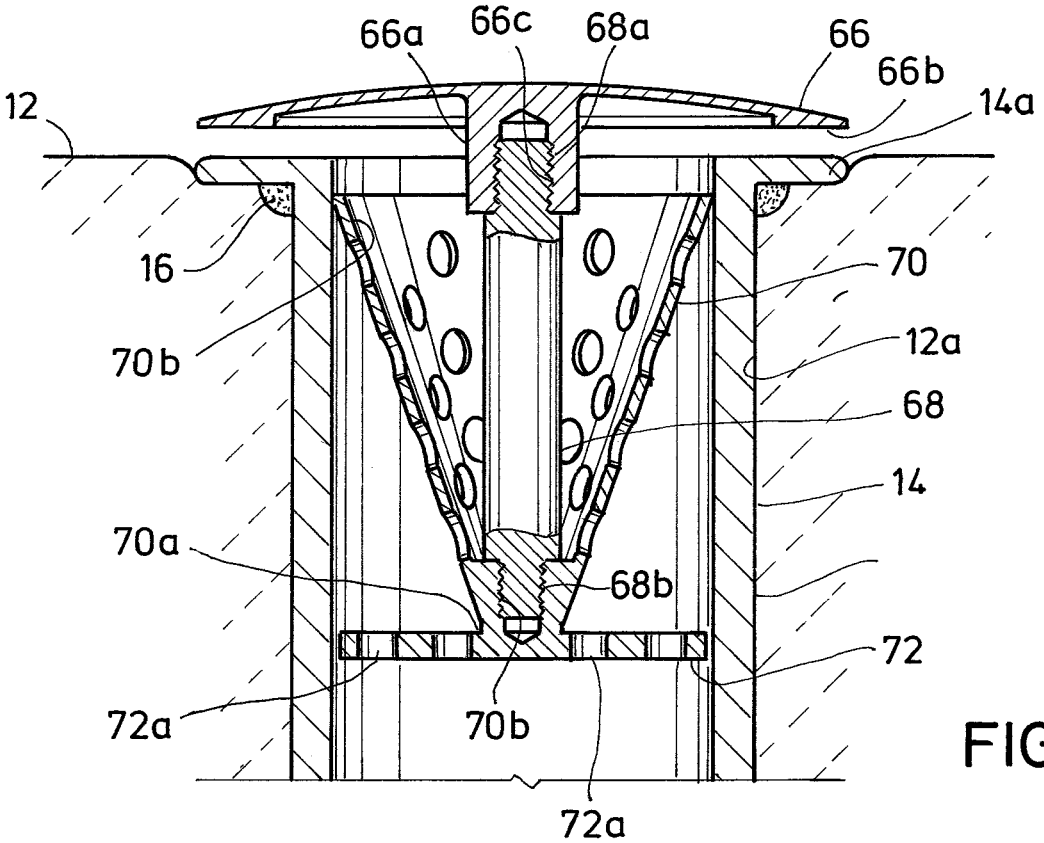
FIG. 5B is a side elevation in cross-section of a drain flange cover having a longitudinal shaft, a disk on the lower end of the shaft and a strainer basket surrounding the shaft, according to the present invention.

With reference to FIGS. 5A and 5B, the central, longitudinal shaft 60*a* in FIG. 5A is fixed to or formed integral with the drain flange cover 60 and the disc 62. A drain flange cover 66 is very similar to the one if FIG. 5A, except a central, longitudinal shaft 68 has a male-threaded upper end 68*a*, and the drain flange cover 66 has a central tubular projection 66*a* on its lower side 66*b* with female threads 66*c* for threaded engagement with the shaft 68. Shaft 68 has a male-threaded lower end 68*b*. A regular funnel-shaped strainer basket 70 has a lower end 70*a*, which has a bore with female threads 70*b*. Strainer 70 is threaded onto the lower end 68*b* of the shaft 68 and has a threaded engagement between the female threads 70*b* in the lower end 70*a* of the strainer 70 and the male threads 68*b* on the lower end of the shaft 68. A strainer disc 72 is either in a threaded engagement with the male threads 68*b* on the lower end of the shaft 68 or is otherwise fixed to the lower end 68*b* of the shaft 68. The strainer disc has a plurality of holes 72*a* and preferably fits snugly in the drain pipe 14. An upper end 70*b* of the strainer 70 has a larger diameter than the lower end 70*a* and fits snugly inside the drain pipe 14, thereby centralizing the drain flange cover 66 over and thereby covering and hiding the drain flange 14*a*.

Figure 5C:
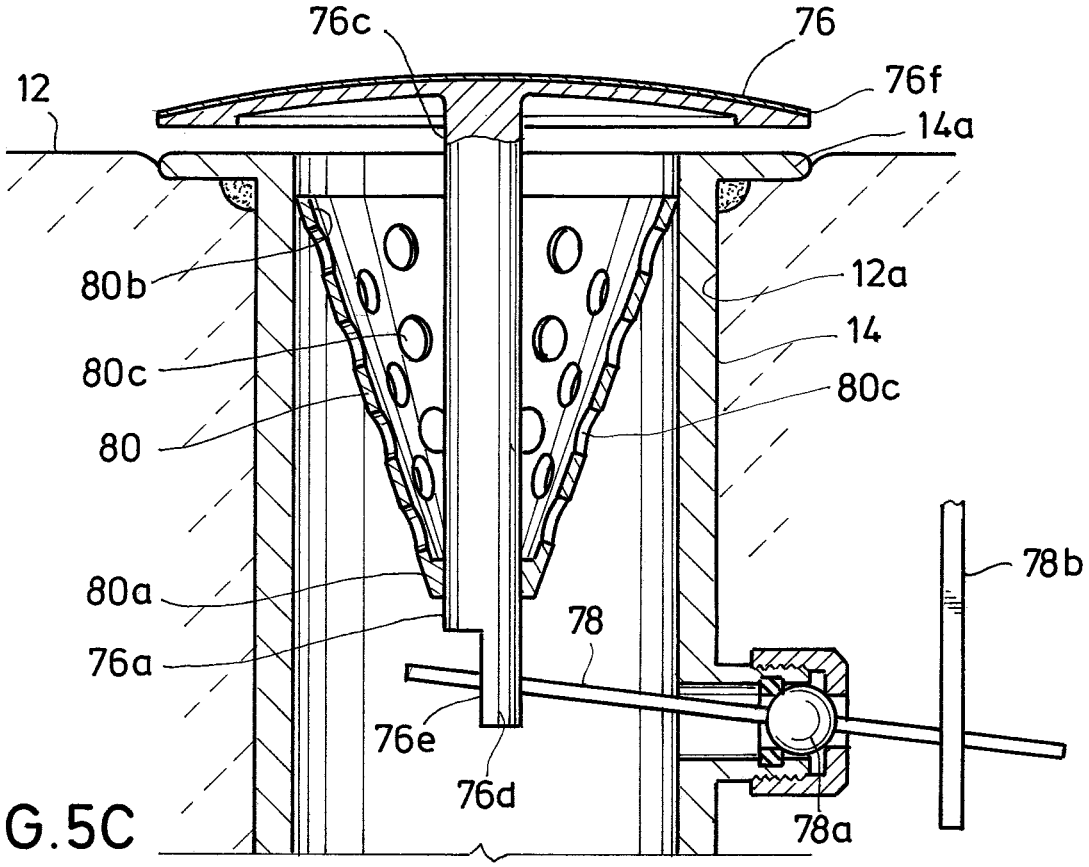
FIG. 5C is a side elevation in cross-section of a drain flange cover having a longitudinal shaft, a pivot rod holder on the lower end of the shaft and a strainer basket surrounding the shaft, according to the present invention.

FIG. 5C is a side elevation in cross-section of a drain flange cover 76 in the sink or bathtub 12, which has the drain opening 12*a* and the drain pipe 14 and drain flange 14*a*. A solid, central, longitudinal shaft 76*a* projects perpendicularly from the underside of the drain flange cover 76. An upper end 76*c* of shaft 76*a* is fixed to the underside of the drain flange cover 76, and a lower end 76*d* of shaft 76*a* has a means 76*e* for receiving a pivot rod 78. Pivot rod 78 can be received in the drain pipe 14 as described above. A strainer basket 80 surrounds the shaft 76*a* and has a lower end 80*a* that fits snugly around or is secured to the shaft 76*a*. Strainer basket 80 has the shape of a regular funnel with a large diameter at an upper end 80*b*, which fits snugly inside the drain pipe 14, and a relatively smaller diameter at the lower end 80*a*. Strainer 80 has a plurality of holes 80*c*, which strain water that flows into the open upper end 80*b* and out through the holes 80*c*, catching hair, debris and objects inside the strainer 80. The pivot rod 78 can be pivoted about a pivot ball 78*a* by lifting up and pushing down on a control rod 78*b*, thereby closing or opening the drain flange cover 76. Water can be retained in the sink or bathtub 12 while the drain flange cover 76 is closed against the drain flange 14*a*, provided a suitable seal or gasket is included in the drain stopper device. Alternatively, standoffs can be included between the drain flange cover 76 and the drain flange 14*a* for maintaining the drain flange cover 76 in an open position. If the means 76*e* for receiving the pivot rod 78 allows the shaft 76*a* to be easily disengaged from the pivot rod 78, then the drain flange cover 76 can be pulled out of the drain pipe 14 for cleaning out hair, debris and objects from inside the strainer 80. One such means 76*e* is a two-prong fork that engages the pivot rod 78 in a friction fit.

Figure 5D:
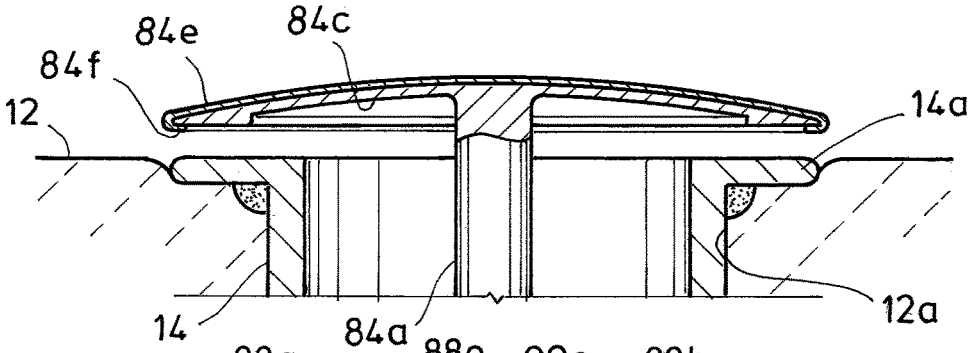
FIG. 5D is a side elevation in cross-section of a drain flange cover having a longitudinal shaft, according to the present invention.

With reference to FIGS. 5C and 5D, a decorative sheet of material 76*f* is shown attached to an upper surface of the drain flange cover 76 in FIG. 5C. The means for attachment of the decorative sheet 76*f* to the upper surface of the drain flange cover 76 include adhesion, suction and magnetic attraction. FIG. 5D is a side elevation in cross-section of a drain flange cover 84 in the sink or bathtub 12, which has the drain opening 12*a* and the drain pipe 14 and drain flange 14*a*. A solid, central, longitudinal shaft 84*a* projects perpendicularly from the underside of the drain flange cover 84. An upper end 84*b* of shaft 84*a* is fixed to the underside of the drain flange cover 84. A dome-shaped substructure 84*c* has a size and a shape typical of a cap on a drain stopper. The dome-shaped substructure 84*c* has a curved upper side that comprises the dome shape and an opposing underside. The dome-shaped substructure 84*c* has an upper surface 84*d* that has a curvature of a dome and has a diameter of typically between one and three or four inches for covering and hiding the drain flange 14*a*. A decorative sheet of material 84*e* has a diameter greater than the diameter of the dome-shaped substructure 84*c* and has a perimeter 84*f* that is wrapped under the perimeter of the dome-shaped substructure 84*c*. The decorative sheet of material 84*e* is crimped at its perimeter 84*f* for fastening the sheet of material 84*e* to the dome-shaped substructure 84*c* of the drain flange cover 84. The sheets of material 76*f* and 84*e* can be made of or can have a finish such as chrome, polished chrome, brushed chrome, bronze, oil-rubbed bronze, polished bronze, brushed nickel, polished nickel, polished brass, satin brass, satin bronze, copper, matte black and white. The dome-shaped substructure 84*c* can be made of a plastic or polymeric material.

Figure 6:
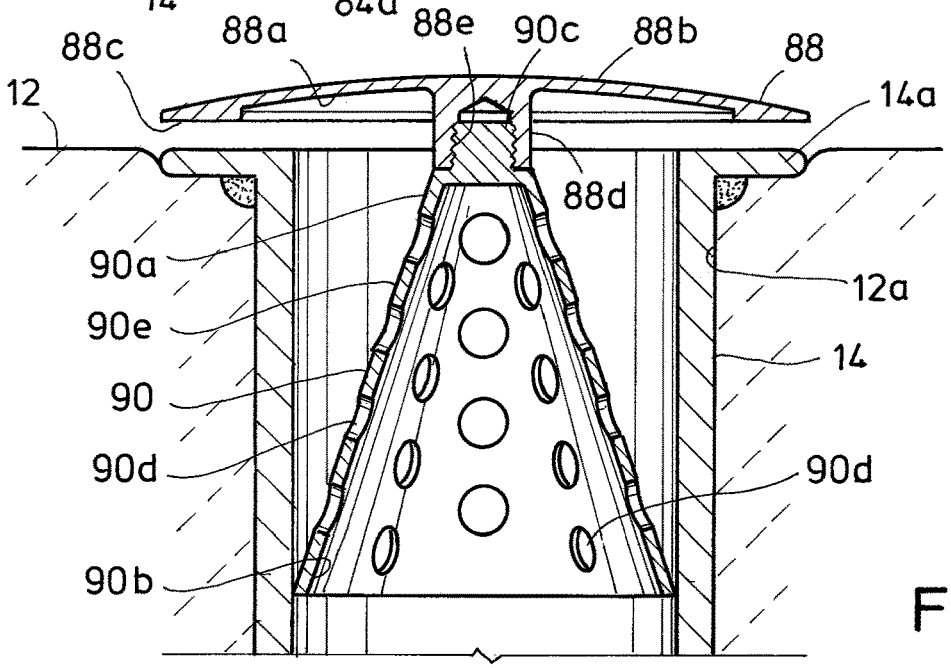
FIG. 6 is a side elevation in cross-section of a drain flange cover that has an inverted-funnel-shaped strainer basket, according to the present invention.

FIG. 6 is a side elevation in cross-section of a drain flange cover 88 in the sink or bathtub 12, which has the drain opening 12*a* and the drain pipe 14 and drain flange 14*a*. Drain flange cover 88 has a dome-shaped substructure 88*a*, which has a curved upper surface 88*b* that comprises the dome shape and an opposing underside 88*c*. Drain flange cover 88 preferably has a decorative sheet of material (not shown) such as described in FIGS. 5C and 5D that covers the upper surface 88*b*. A short tube 88*d* is attached to and projects perpendicularly from the underside 88*c* of the substructure 88*a*. The tube 88*d* is formed integrally with or is attached to the substructure 88*a* and has a bore with female threads 88*e*. A strainer 90 has an inverted funnel shape as opposed to the shape of a regular funnel. Strainer 90 has an upper end 90*a* and a lower end 90*b*. The diameter of the lower end 90*b* is greater than the diameter of the upper end 90*a*, which is what is meant by the inverted funnel shape. A regular funnel shape has a greater diameter at its upper end than at its lower end. An inverted funnel shape has a greater diameter at its lower end than at its upper end. Strainer 90 has a stud 90*c* on its upper end 90*a*, which has male threads that matingly engage the female threads 88*e* in the tube 88*d*. The upper surface of the upper end 90*a* of the strainer 90 is shown as having a diameter equal to that of the outer diameter of the tube 88*d*, but could be slightly greater and could have perforations. The lower end 90*b* of the strainer 90 has an outside diameter that allows the strainer 90 to fit snugly inside the drain pipe 14 and may or may not have a seal such as a gasket or an O-ring that slides within the drain pipe 14. Strainer 90 has openings 90*d* through which water can drain, while hair, debris and objects are caught on an outer surface 90*e* of the strainer 90. Catching hair, debris and objects on the outer surface 90*e* may allow for easier cleaning of the strainer 90 than catching the same on an inner surface in a regular funnel. Although not shown, drain flange cover 88 may also have a set of standoffs that include centering legs such as described with reference to FIG. 4B for keeping the drain flange cover 88 centered over the drain pipe 14 so that it always covers the drain flange 14*a*. Drain flange cover 88 is shown with the dome-shaped substructure 88*a* being solid and impermeable. However, the drain flange cover 88 could be a strainer with holes or openings and could be flat rather than dome shaped. In either case, the drain flange cover would preferably include a decorative sheet or be made of a decorative material for providing a desired finish appearance. Although not shown, a central, longitudinal shaft such as the shaft 76*a* described with reference to FIG. 5C can be attached at an upper end to the upper end 90*a* of the strainer 90, and the lower end of the shaft can be engaged by a means for opening and closing such as a pivot rod. In this embodiment, the drain flange cover 88 would include means for sealing the drain flange cover 88 with the drain flange 14*a* so that water can be retained within the sink or bathtub 12.

FIG. 6 describes a drain flange cover comprising: a dome-shaped structure having an upper surface that has a curvature of a dome and an opposing lower surface, where the dome-shaped structure is sized and designed to cover and hide the drain flange; and a screen having an upper end attached to or formed integral with the lower surface and an opposing lower end, where the screen has a longitudinal axis that is generally perpendicular to the lower surface of the dome-shaped structure, where the lower end of the screen has a diameter that is approximately equal to the diameter of the drain opening, where the upper end has a diameter that is substantially smaller than the diameter of the lower end, where the screen has openings through which water can pass and structural elements that define the openings, and where hair and debris in the water tends to be caught by the structural elements. The screen has the shape of a cone, preferably a frustoconical shape. The screen is preferably shaped and positioned as an inverted funnel. The screen may be a wire mesh, a plastic mesh or a perforated sheet of material. The drain flange cover preferably includes a disc attached to or formed integral with the lower end of the screen. The disc may be a wire mesh, a plastic mesh or a perforated sheet of material. A ring may be attached to or formed integral with the lower end of the screen. The disc or the ring is preferably sized and designed to fit tightly within drain pipe 14. A seal may be included around the perimeter of the disc or ring.

Figure 7:
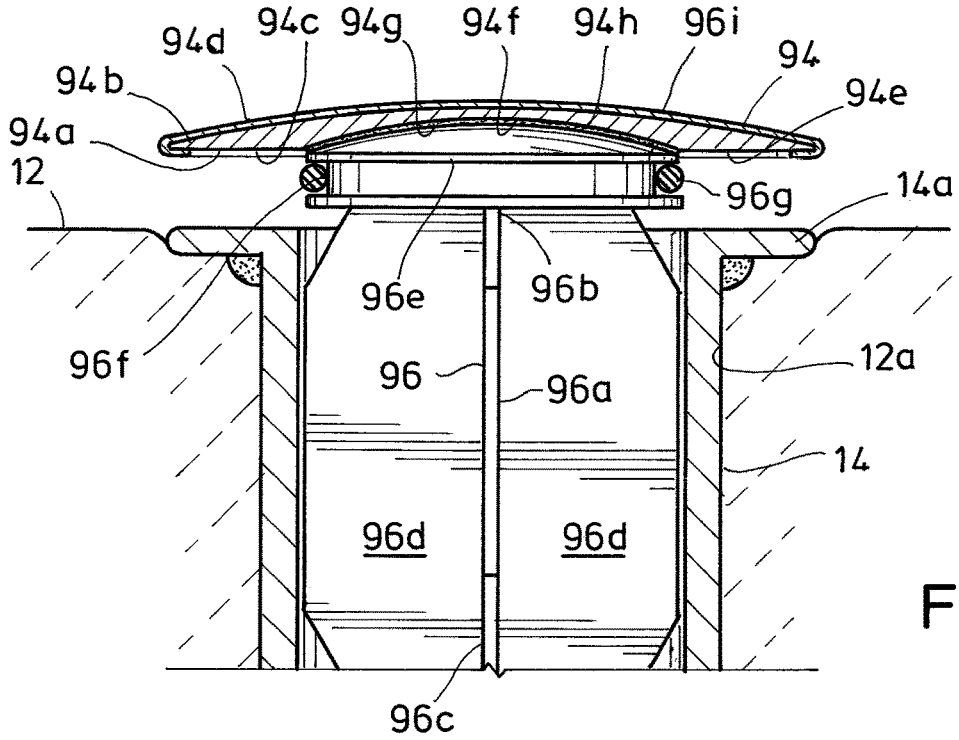
FIG. 7 is a side elevation in cross-section of a drain flange cover attached to the cap of a drain stopper, according to the present invention.

FIG. 7 is a side elevation in cross-section of a drain flange cover 94 in the sink or bathtub 12, which has the drain opening 12*a* and the drain pipe 14 and drain flange 14*a*. Drain flange cover 94 has a dome-shaped substructure 94*a*, which has a curved upper surface 94*b* that comprises the dome shape and an opposing underside 94*c*. Drain flange cover 94 includes a decorative sheet of material 94*d* such as described in FIGS. 5C and 5D that covers the upper surface 94*b*. The underside 94*c* of the drain flange cover 94 has a generally flat and straight portion 94*e* adjacent to the perimeter of the drain flange cover 94 and a recess 94*f* in a central portion that is surrounded by the flat, straight portion 94*e*. The recess 94*f* is defined by a smooth, curved surface 94*g* that has a curvature and shape similar to or nearly identical to the curved upper surface 94*d* that provides the dome shape for the dome-shaped substructure 94*a*. A drain stopper 96 is received inside the drain pipe 14. Drain stoppers are described in the U.S. Patent Application Pub. Nos. 2017/0260724 A1, 2017/0314244 A1 and 2017/0314245 A1 noted above. Drain stopper 96 has a central longitudinal shaft 96*a*, an upper end 96*b*, a lower end 96*c*, and centralizing fins 96*d*. A cap 96*e* is attached to the upper end 96*b* of the shaft 96*a*. Cap 96*e* has a recessed portion 96*f* in which an O-ring 96*g* is received. Cap 96*e* has a dome-shaped upper and outer surface 96*h* that has about the same shape as the curved surface 94*g* and is sized and shaped to be matingly received in the recess 94*f*. Drain flange cover 94 is fastened to the cap 96*e* by a means 96*i*, and the dome-shaped upper and outer surface 96*h* of the cap 96*e* fits in the recess 94*f* of the drain flange cover 94. The dome-shaped upper and outer surface 96*h* of the cap 96*e* fits matingly along the smooth, curved surface 94*g* that defines the recess 94*f*. The means 96*i* for fastening the drain flange cover 94 to the drain stopper 96 may be a layer of adhesive, a layer of glue with a peel-and-stick film that can be removed, a magnetic attraction and suction. Thus, a dome-shaped drain flange cover has a convex upper surface that has a curvature of a dome and an opposing concave lower surface, which is sized and designed to mate with a convex upper surface of a cap on a drain stopper. A magnet or glue in or on the concave lower surface fastens the dome-shaped structure to the cap on the drain stopper. Suction can be used instead of magnetic attraction and adhesion to fasten the drain flange cover to the cap on the drain stopper.

FIG. 7 describes a drain flange cover for covering a drain flange around a drain opening in a sink or bathtub that has a drain stopper in the drain opening, where the drain stopper has a cap that has a convex upper surface. The drain flange cover comprises: a dome-shaped structure that has a convex upper surface that has a curvature of a dome and an opposing concave lower surface that is sized and designed to mate with the convex upper surface of the cap on the drain stopper; and a magnet or glue in or on the concave lower surface for fastening the dome-shaped structure to the cap on the drain stopper. The dome-shaped structure preferably has a diameter of between one and three inches and is sized to cover and hide the drain flange. The diameter of the drain flange cover is typically about two inches for a sink and about two and a half inches for a bathtub drain flange. A sheet of a decorative material preferably covers the convex upper surface of the dome-shaped structure. The sheet of a material can be glued on or can lap under the dome-shaped structure. The sheet is preferably laps under and is crimped under the dome-shaped structure for fastening the sheet of material to the dome-shaped structure.

Figure 8A:
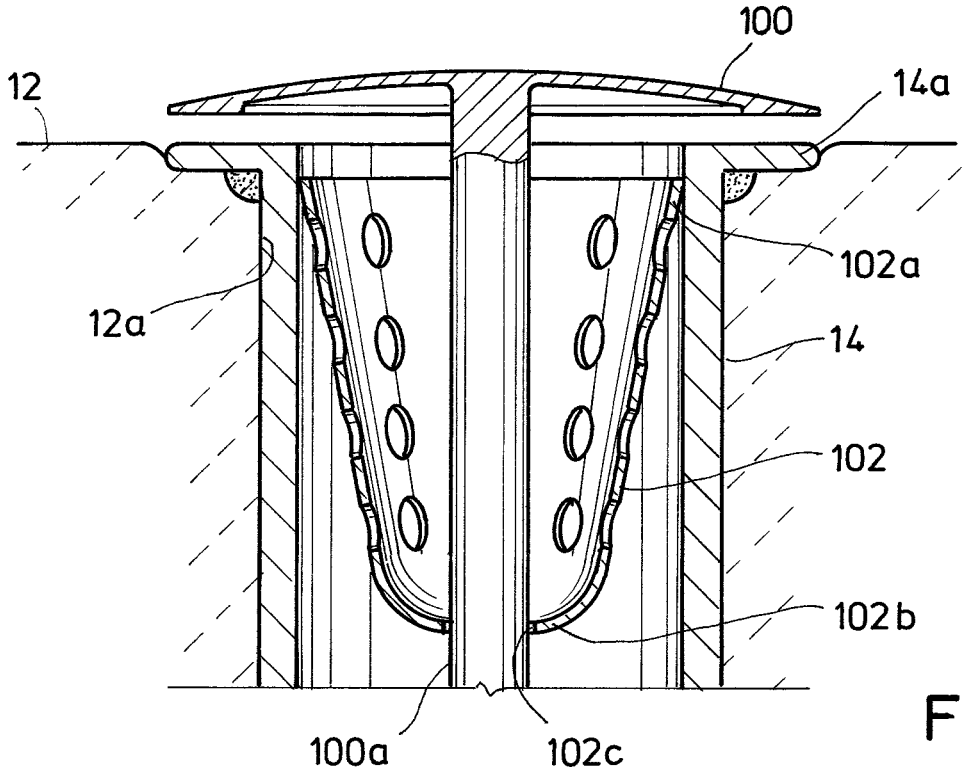
FIG. 8A is a side elevation in cross-section of a drain flange cover having a longitudinal shaft and a strainer basket surrounding the shaft, according to the present invention.

FIG. 8A is a side elevation in cross-section of a drain flange cover 100 in the sink or bathtub 12, which has the drain opening 12*a* and the drain pipe 14 and drain flange 14*a*. A solid, central, longitudinal shaft 100*a* projects perpendicularly from the underside of the drain flange cover 100. A strainer basket 102 having a U-shaped longitudinal cross-section has an open upper end 102*a* and a lower end 102*b*. The lower end 102*b* has a smaller diameter than the upper end 102*a*. The lower end 102*b* has an opening 102*c*, which is sized so that the lower end 102*b* fits snugly around the shaft 100*a*. The upper end 102*a* is sized to fit snugly inside the drain pipe 14. Standoffs with centering legs can be used to center the drain flange cover 100 in the drain opening, or transverse structural elements can extend between the shaft 100*a* and the strainer 102 for centering the shaft inside the strainer, thereby centering the drain flange cover 100 over the drain opening 12*a* to ensure the drain flange cover 100 hides the drain flange 14*a*.

Figure 8B:
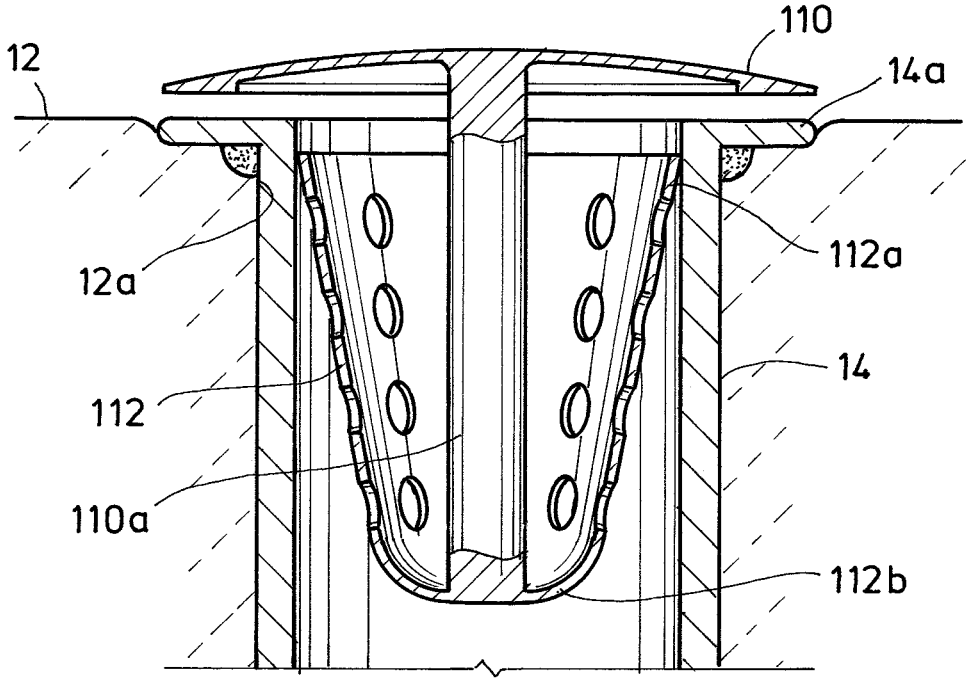
FIG. 8B is a side elevation in cross-section of a drain flange cover having a longitudinal shaft and a strainer basket surrounding the shaft, according to the present invention.

FIG. 8B is a side elevation in cross-section of a drain flange cover 110 in the sink or bathtub 12, which has the drain opening 12*a* and the drain pipe 14 and drain flange 14*a*. A solid, central, longitudinal shaft 110*a* projects perpendicularly from the underside of the drain flange cover 110. A strainer basket 112 having a U-shaped longitudinal cross-section has an open upper end 112*a* and a lower end 112*b*. The lower end 112*b* has a smaller diameter than the upper end 112*a*. The lower end 112*b* is fixed to the lower end of the shaft 110*a*. The upper end 112*a* is sized to fit snugly inside the drain pipe 14. Most aspects of the drain flange cover 100 in FIG. 8A also apply to the drain flange cover 110 in FIG. 8B.

FIGS. 8A and 8B describe a drain flange cover that comprises: a dome-shaped structure having an upper surface that has a curvature of a dome and an opposing lower surface, wherein the dome-shaped structure is sized and designed to cover and hide the drain flange; a shaft having an upper end attached to or formed integral with the dome-shaped structure and an opposing lower end, where the shaft projects perpendicular from the lower surface of the dome-shaped structure; and a strainer basket surrounding the shaft, where the strainer basket is fixed to the dome-shaped structure or to the shaft or is removably attached to the dome-shaped structure or to the shaft. The strainer basket is sized to fit snugly in the drain opening. Centering elements are preferably included to ensure that the drain flange cover hides the drain flange. A snug fit of the upper end of the strainer basket inside the drain pipe will function as a centralizer, particularly if the strainer basket is generally rigid.

Figure 9:
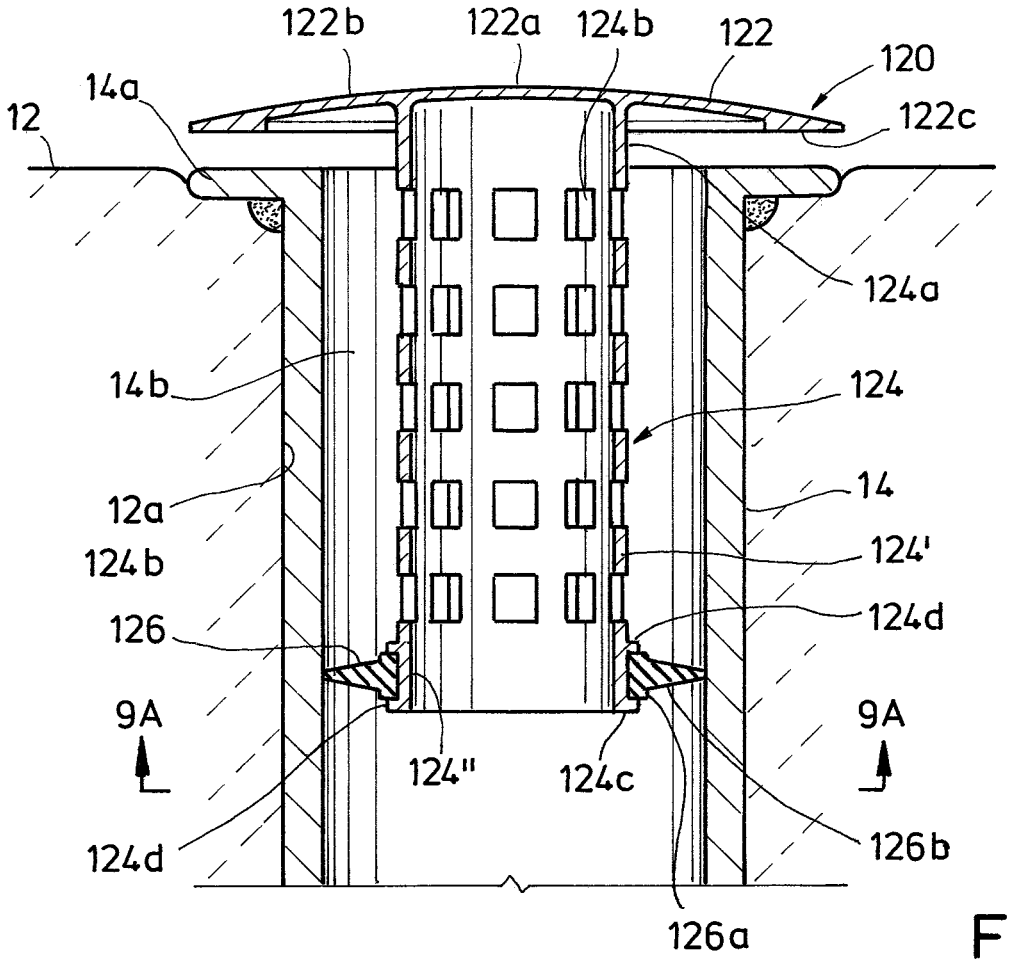
FIG. 9 is a side elevation in cross-section of a drain flange cover having a perforated tubular shaft as a strainer basket, according to the present invention.

FIG. 9 is a side elevation in cross-section of a drain flange cover and strainer 120 in the sink or bathtub 12, which has the drain opening 12*a* and the drain pipe 14 and drain flange 14*a*. The drain flange cover and strainer 120, which will be referred to as the cover/strainer 120, is similar to drain flange cover 40, which was described with reference to FIG. 3A. Much of the description of drain flange cover 40 applies to cover/strainer 120. Cover/strainer 120 includes a flange cover 122 in an upper portion, which has a dome-shaped structure 122*a* with an upper and outer surface 122*b* and a lower side that includes a washer-shaped lower surface 122*c*. A strainer 124 has a central, longitudinal, tubular, cylindrical strainer body 124' that has an upper end 124*a*, which is attached to or formed integral with the lower side of the flange cover 122. In this embodiment, strainer 124 is formed integral with the flange cover 122, and the washer-shaped lower portion with the lower surface 122*c* surrounds the strainer 124. Strainer 124 has holes or openings 124*b*, which are shown as having a square shape, which instead could be circular or oval or which could be a plurality of slits or slots. Strainer 124 can be described as a perforated tubular shaft that depends downwardly from the underside of the cap.

Strainer 124 has a lower end 124*c*, and a flange 124*d* surrounds the perimeter of the cylindrical lower portion of the strainer 124 adjacent to its lower end 124*c*. Flange 124*d* has upper and lower shoulders that project radially from the strainer body 124' with respect to the longitudinal axis of the strainer body 124', which are separated by a base portion. Flange 124*d* has a U-shaped cross-section, where the upper and lower shoulders are the base portion of the U-shape. A ring-shaped gasket 126 is received in the flange 124*d*. Gasket 126 has a base portion 126*a*, which in cross-section has a rectangular shape, and a wiper portion 126*b* that tapers thinner as it projects more radially. Gasket 126 is sized and designed to fit snugly inside the drain pipe 14. Gasket 126 can be sized and designed to fit sufficiently tightly inside the inside wall of the drain pipe 14 to hold the strainer body 124' and the flange cover 122 in a desired position. In the case of a tub drain, the cover/strainer might rest on a tub shoe typically found in a drain pipe connected to a bathtub. Centering flanges are not shown, but can be added to maintain the cover/strainer 120 in the center of the drain pipe 14. Spacers are not shown, but can be added to ensure there is a space between the lower surface 122*c* of the flange cover 122, so that water can drain out of a sink or bathtub into the drain pipe 14. Drain flange cover and strainer 120 can be modified to include elements similar to the standoffs 56 and the centering legs 56*a* shown in FIG. 4B. A combined spacer-centralizer element can be attached to the underside of the cap and/or to the tubular shaft for maintaining a space between the cap and the drain flange and for centering the strainer 124 in the drain pipe.

Figure 9A:
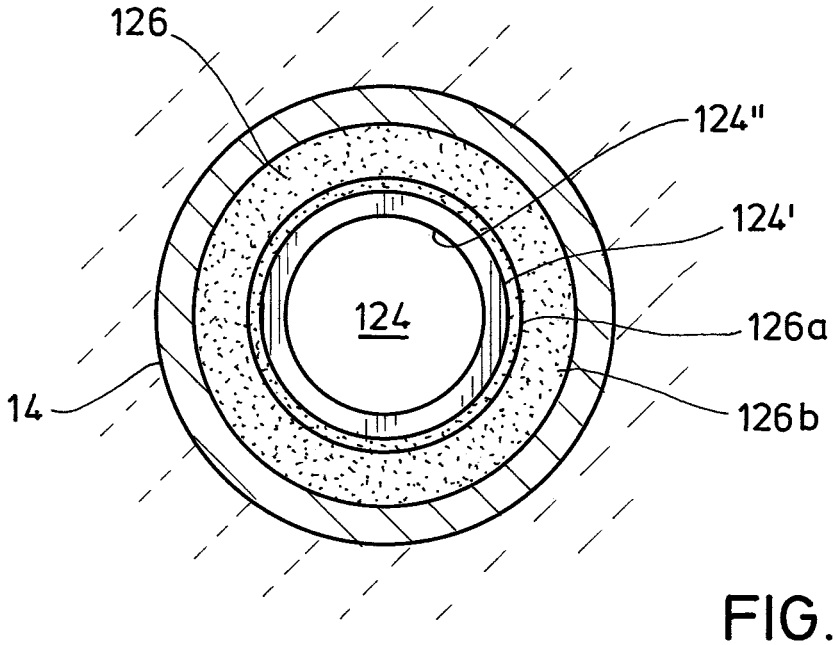
FIG. 9A is a cross-section of the drain flange cover of FIG. 9 as seen along the line 9A-9A.

Water drains under the flange cover 122 below its lower surface 122*c* and above the drain flange 14*a*. Flange cover 122 has a solid upper and outer surface 122*b* with no holes or openings, so water does not flow through flange cover 122. Consequently, the flange cover 122 has the appearance of a normal drain stopper, except for being wide enough to cover and hide the drain flange 14*a*. Gasket 126 provides a solid and sealed barrier so that water does not tend to drain through an annular space 14*b* between an outside surface of the strainer body 124' and an inside wall surface of the drain pipe 14. Water drains into the annular space 14*b* and through the holes or openings 124*b* and into a central drain space 124*e*, which is defined by an inside wall surface 124" of the tubular strainer body 124', as best seen in FIG. 9A. Hair, debris and objects that do not readily pass through the openings 124*b* tend to be caught and contained within the annular space 14*b*. Strands of hair of a sufficient length may tend to wrap around the strainer body 124'. The diameter of flange cover 122 can be related to the diameter of the gasket, which is approximately the inside diameter of the drain pipe. The inside diameter of drain pipe from sinks and bathtubs is often 1.25 or 1.50 inches. The drain flange may extend radially from about 0.25 to about 0.50 inches beyond the inside diameter, so the diameter of the drain flange may approximately range from [(1.25+0.25+0.25)=1.75] to [(1.50+0.50+0.50)=2.50] inches. The drain flange cover should have a diameter at least as great as the diameter of the drain flange, preferably slightly greater. The diameter of the drain flange cover may typically range from 1.75 inches to 2.50, 2.75 or 3.00 inches, depending on the size of the drain flange to be covered. The diameter of the drain flange cover may be typically at least 0.50 to 1.00 inch greater than the diameter of the gasket, assuming the diameter of the gasket is the same as the inside diameter of the drain pipe and that the drain flange extends 0.25 to 0.50 inch beyond the inside diameter, in order for the drain flange cover to cover and hide the drain flange. The diameter of the drain flange cover for a drain flange in a bathroom sink is preferably about 2.5 inches.

FIG. 10 is a side elevation in cross-section of a drain flange cover and strainer 130 in the sink or bathtub 12, which has the drain opening 12*a* and the drain pipe 14 and drain flange 14*a*. Cover/strainer 130 includes a flange cover 132 in an upper portion, which has a dome-shaped structure 132*a* with an upper and outer surface 132*b* and a lower side that includes a washer-shaped lower surface 132*c*. A strainer 134 has a central, longitudinal, tubular, cylindrical strainer body 134' that has an upper end 134*a*, which is attached to the lower side of the flange cover 132 using a threaded connection. In this embodiment, the flange cover 132 has a short tube 132*d* projecting from its lower side, which has threads inside the tube. Strainer 134 has threads on the outside of its tubular shape adjacent to its upper end 134*a*, which thread into the threads in the short tube 132*d*, thereby fastening the strainer 134 to the flange cover 132. This threading arrangement can be reversed, and a connection other than threading can be used, such as press fit, snap fit, interlock fit, formed integral together or a glued fitting. Strainer 134 has a plurality of holes or openings 134*b*.

Strainer 134 has a lower end 134*c*, and a flange 134*d* surrounds the perimeter of the cylindrical lower portion of the strainer 134 adjacent to its lower end 134*c*. Flange 134*d* has upper and lower shoulders that project radially from the strainer body 134' with respect to the longitudinal axis of the strainer body 124', which are separated by a base portion. Flange 134*d* has a U-shaped cross-section, where the upper and lower shoulders are the base portion of the U-shape. A ring-shaped gasket 136 is received in the flange 134*d*. Gasket 136 has a base portion 136*a*, which in cross-section has a rectangular shape, and a wiper portion 136*b* that tapers thinner as it projects more radially. Gasket 136 is sized and designed to fit snugly inside the drain pipe 14. Gasket 136 can be sized and designed to fit sufficiently tightly inside the inside wall of the drain pipe 14 to hold the strainer body 134' and the flange cover 132 in a desired position.

Water drains under the flange cover 132 below its lower surface 132*c* and above the drain flange 14*a*. Flange cover 132 has a solid upper and outer surface 132*b* with no holes or openings, so water does not flow through flange cover 132. Consequently, the flange cover 132 has the appearance of a normal drain stopper, except for being wide enough to cover and hide the drain flange 14*a*. Gasket 136 does not provide a solid and sealed barrier so that water does tend to drain through the annular space 14*b* between the outside surface of the strainer body 134' and the inside wall surface of the drain pipe 14. Water drains into the annular space 14*b* and through the holes or openings 134*b* and into a central drain space 134*e*, which is defined by an inside wall surface 134" of the tubular strainer body 134'.

Figure 10B:
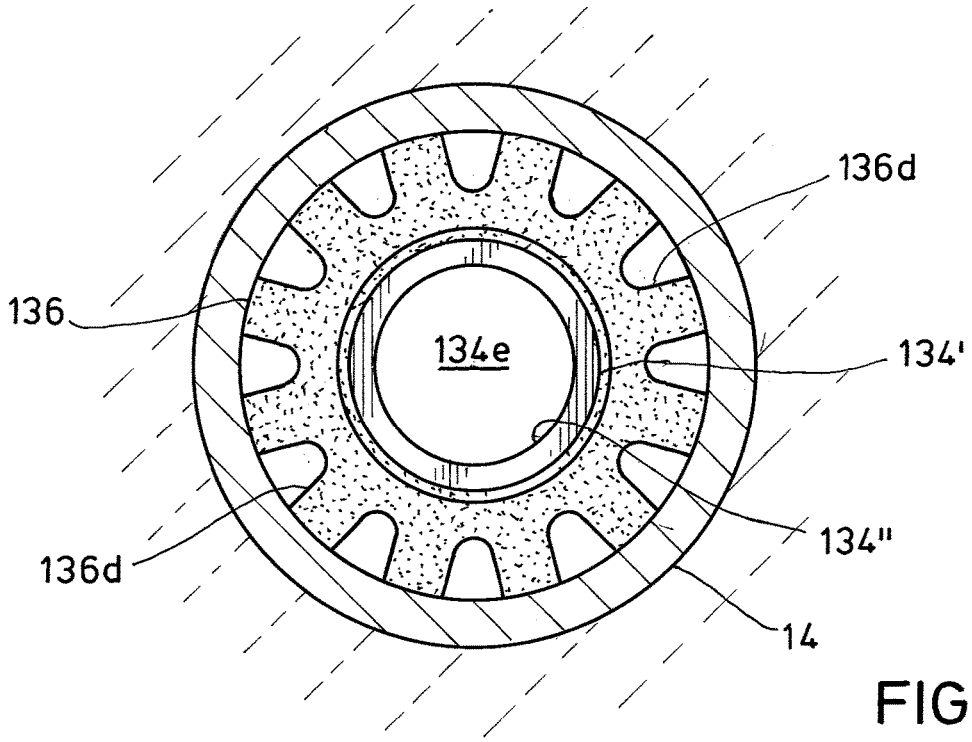
FIG. 10B is a cross-section of the drain flange cover of FIG. 10 as seen along the line 10B-10B.

FIG. 10A is a plan view of the underside of drain flange cover and strainer 130. Gasket 136 is shown in FIG. 10A as having openings 136*c* through which water can pass for draining the sink or bathtub. FIG. 10B is a plan view of the underside of drain flange cover and strainer 130. Gasket 136 is shown in FIG. 10B as having notches 136*d* along its perimeter, which prevents the gasket from having a tight seal against the inside wall of the drain pipe 14. Consequently, water can pass between the inside wall of the drain pipe 14 and the outer perimeter of the gasket 136 at the notches 136*d*. Hair, debris and objects that do not readily pass through the openings 134*b* in the strainer body 134' or through the openings or notches 136*c* or 136*d*, respectively, in the gasket 136 tend to be caught and contained within the annular space 14*b*.

Figure 11:
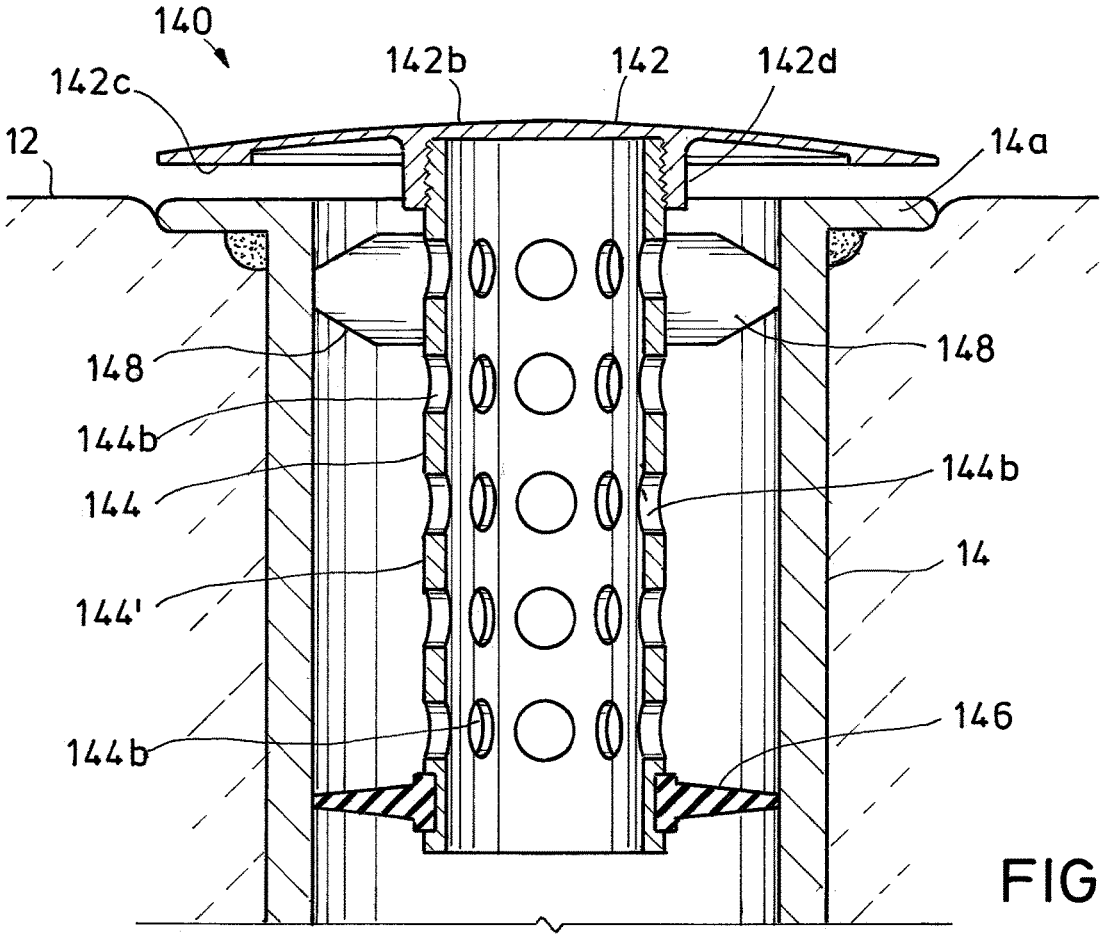
FIG. 11 is a side elevation in cross-section of a drain flange cover having a perforated tubular shaft as a strainer basket, according to the present invention.

FIG. 11 is a side elevation in cross-section of a drain flange cover and strainer 140 in the sink or bathtub 12, which has the drain opening 12*a* and the drain pipe 14 and drain flange 14*a*. Cover/strainer 140 includes a flange cover 142 in an upper portion, which has a dome-shaped structure 142*a* with an upper and outer surface 142*b* and a lower side that includes a washer-shaped lower surface 142*c*. A strainer 144 has a central, longitudinal, tubular, cylindrical strainer body 144' that has an upper end 144*a*, which is attached to the lower side of the flange cover 142 using a threaded connection as described for FIG. 10. Strainer 144 has holes or openings 144*b*, and a solid gasket 146 seals the strainer body 144' inside the drain pipe 144. Flange cover 142 has a short tube 142*d* projecting from its lower side, which has threads inside the tube. Strainer 144 has threads on the outside of its tubular shape adjacent to its upper end 144*a*, which thread into the threads in the short tube 142*d* for fastening the strainer 144 to the flange cover 142. Strainer 144 has holes or openings 144*b*.

Drain flange cover and strainer 140 includes centralizing fins 148. The centralizing fins 148 can be attached to either the flange cover 142, such as to the short tube 142*d*, or to the strainer body 144. Centralizing fins 148 extend radially outwardly from the longitudinal axis of the cover/strainer 140 to a point adjacent to the inside wall of the drain pipe 14 and tend to keep the cover/strainer 140 centered in the drain pipe 14 with the flange cover 142 fully hiding and covering the entire drain flange 14*a*. The centralizing fins can be modified to also serve as standoffs to space the flange cover 142 apart from the drain flange 14*a* and can instead be located on the tube 142*d* that projects downwardly from the underside of the drain flange cover 142.

The drain flange covers and the drain flange cover and strainers of the present invention are typically made to have a rigid structure and can be made of materials such as metal, acrylonitrile butadiene styrene (ABS) polymers, polystyrene, polyethylene and polypropylene to name a few of many possibilities. The flange covers and cover/strainers of the present invention would be unlikely to be made of highly flexible and highly resilient material such as silicones or polysiloxanes and rubbers such as styrene butadiene rubber, although the present invention is not limited to a particular material or even to being rigid.

Figure 12B:
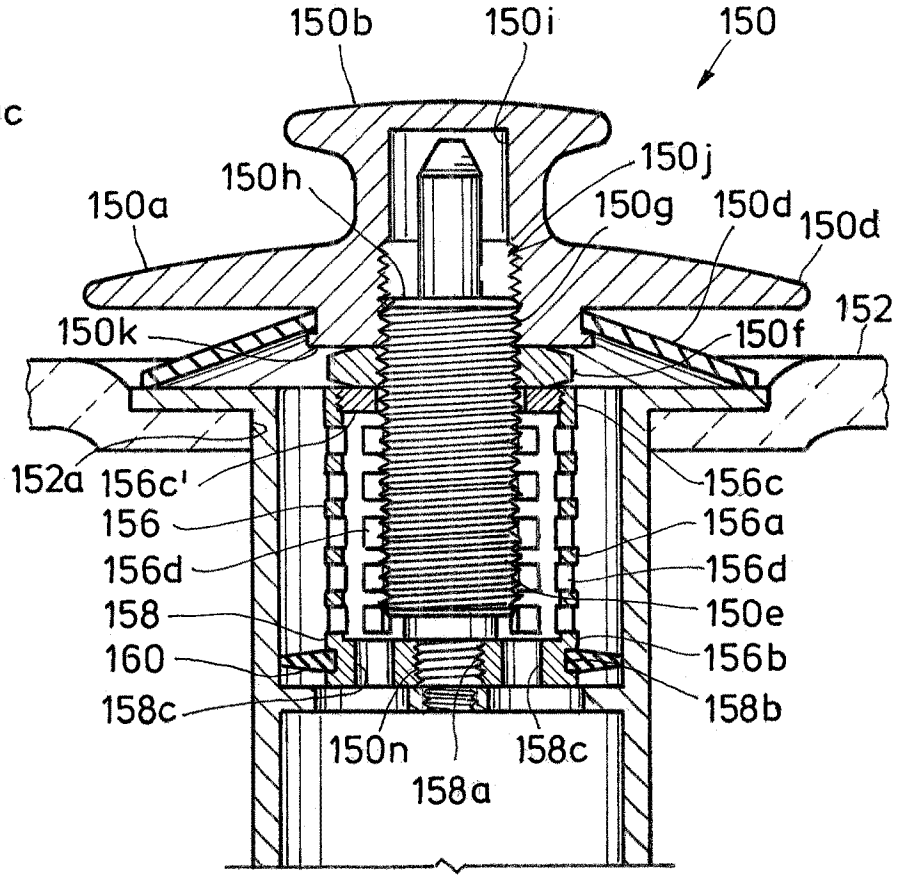
FIG. 12B is a side elevation in cross-section of a bathtub drain stopper and drain flange cover of FIG. 12A in its closed position.
Figure 12A:
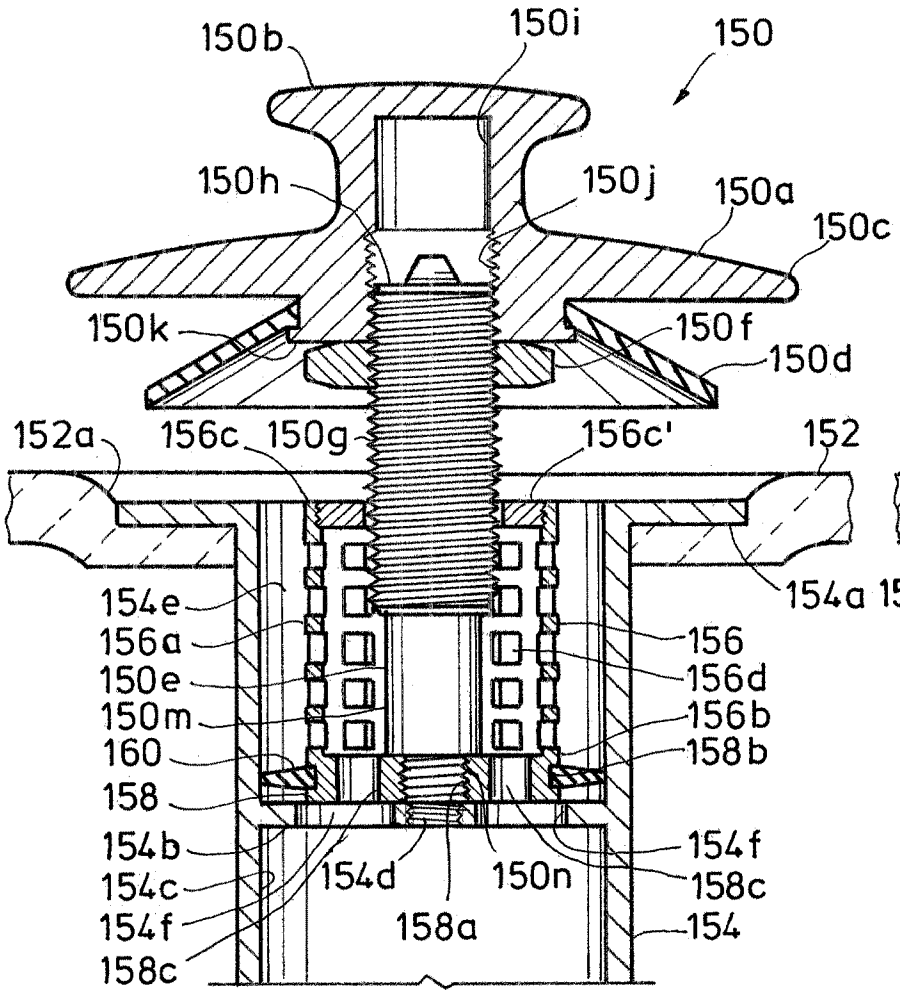
FIG. 12A is a side elevation in cross-section of a bathtub drain stopper and drain flange cover with a strainer basket, which is in its open position, according to the present invention.

FIGS. 12A and 12B are side elevations in cross-section of a drain stopper 150 for a bathtub 152, which has a drain opening 152*a* and a drain pipe 154 and a drain flange 154*a* sealed about the drain opening 152*a*. FIG. 12A shows drain stopper 150 in an open position, and FIG. 12B shows drain stopper 150 in a closed position. Drain pipe 154 may be referred to as a tub shoe, presumably because it generally has a 90-degree elbow close to the underside of the tub. Cross-bars 154*b* are attached to an inside wall 154*c* of the drain pipe 154. Alternatively, the drain pipe may include a fitting with female threads, and the drain flange is part of a cup-shaped fitting with male threads that thread into the female threads and has the cross-bars in the bottom of the cup-shaped fitting. Cross-bars 154*b* have a central threaded opening 154*d*. Drain stopper 150 includes a cap 150*a*, which has a grip portion 150*b*, a large and decorative drain cover 150*c*, a seal 150*d*, which seals against the drain flange 154*a*, a push-push mechanism 150*e* and a lock nut 150*f*. The push-push mechanism 150*e* has male threads 150*g* on an upper end 150*h*. Cap 150*a* has a cylindrical bore 150*i* along a longitudinal axis, which has female threads 150*j*. The male threads 150*g* are threaded into the female threads 150*j* in the cap 150*a*, and extra space in the bore 150*i* allows for adjusting the length of the drain stopper 150*a*. After the length is adjusted a desired amount, the lock nut 150*f* is tightened against an underside 150*k* of the cap 150*a* to maintain the desired length.

The upper end 150*h* of the push-push mechanism 150*e* comprises an upper tube, and a lower end comprises a lower tube 150*m*, which is received inside the upper tube in a sliding engagement. A stud 150*n* projects downwardly from the lower tube 150*m* and has male threads. Although not shown in the drawings, stud 150*n* has a central longitudinal bore defined by female threads, and an adapter can be used to engage or fasten the push-push mechanism 150*e* to the cross-bars 154*b*. The thread arrangements can be reversed throughout the drain stopper 150, and connections can be made that do not rely on a threaded engagement, such as by a press fit or by being made integral.

A strainer 156 has a central, longitudinal, tubular, cylindrical strainer body 156*a*. Strainer 156 has a lower end 156*b*, an upper end 156*c* and slits, slots, holes or openings 156*d* in the body 156*a*. The upper end 156*c* can be left open, but is shown as having a washer-shaped gasket 156*c'* in a threaded engagement with the strainer body 156*a*, which could instead be a press fit connection, a glued connection, an interlocking snap fit connection or a dovetail joint such as used in woodworking. Gasket 156*c'* does not fit tightly against the male threads 150*g* on the upper end 150*h* of the push-push mechanism 150*e*. A disk 158 is attached to or formed integral with the lower end 156*b* of the strainer 156. The disk 158 is oriented transverse to the longitudinal axis of the push-push mechanism 150*e*, similar to a flange that projects radially from the circumference of a pipe. Disk 158 has a central bore 158*a* with female threads and is in threaded engagement with the stud 150*n* on the lower end of the push-push mechanism 150*e*. The thread arrangement can be reversed, and the connection can be other than by threaded engagement, such as a press fit or by adhesion. Disk 158 has an outer perimeter, and a circumferential groove 158*b* is formed in the outer perimeter. A gasket 160 is received in the groove 158*a* and provides a seal between the inside wall 154*c* of the drain pipe 154 and the disk 158. Gasket 160 has a base portion that fits in the groove 158*b* and tapers as it extends radially toward the inside surface 154*c* of the drain pipe 154. An O-ring may be suitable for use as the gasket 160. Disk 158 has a plurality of openings 158*c* extending between its upper and lower planar surfaces so that water can drain downwardly from inside the strainer 156. The disk 158 and the strainer 156 rest on the cross-bars 154*b* in the drain pipe 154. The cross-bars 154*b* define a plurality of openings 154*f* extending between its upper and lower planar surfaces so that water can drain downwardly from the strainer 156 through the openings 158*c* in the disk 158 and through the openings 154*f* in the cross-bars 154*b*. The strainer basket and its disk are shown as resting on the cross-bars, but alternatively, the disk 158 and the strainer 156 can be fastened to the cross-bars 154*b*, preferably by fastening the push-push mechanism 150*e* to the cross-bars 154*b*. This can be accomplished, for example, using an adapter that has male threads on each end of a short rod, where one end threads into the bore in the stud 150*n* and the other end threads into a bore in the cross-bars. This and other aspects of bathtub drain stoppers are explained more fully in the present inventors' related U.S. Patent Application Pub. No. 20170314245 A1, application Ser. No. 15/584,032, which is incorporated by reference in its entirety for all purposes.

Push-push mechanism 150*e* can be a conventional push-push mechanism that comprises a hollow cylinder with a spring and ratchet mechanism inside, which holds the mechanism (and, consequently, the drain stopper 150) in two positions, namely an open position and a closed position. U.S. Pat. No. 3,428,295, issued to Downey et al., discloses a push-push drain stopper with a spring and ratchet mechanism and is incorporated by reference for all purposes. Thompson et al. disclose a push-push drain stopper that uses a cam track in their U.S. Pat. No. 4,007,500, which is incorporated by reference. FIG. 12B shows the push-push mechanism 150*e* in the closed position with the seal 150*d* pressed against the drain flange 154*a*. While in the open position of FIG. 12A, a downward push on the gripping portion 150*b* of the cap 150*a* pushes the lower tube 150*m* into the upper tube 150*h*, thereby moving the push-push mechanism 150*e* from a first, open position shown in FIG. 12A to a second, closed position shown in FIG. 12B, which presumably puts a spring inside the tubes in an energized state. A downward push on cap 150*a* while in the closed position shown in FIG. 12B moves a ratchet or cam mechanism or some similar device, and the spring inside the tubes pushes the upper and lower tubes apart to return the drain stopper to the open position of FIG. 12A. One pushes downwardly on the upper end 150*b* of the cap 150*a* to open and to close the drain stopper 150. Drain stopper 150 is push to open and push to close.

A bathtub can be filled with water while the drain stopper 150 is in the closed position of FIG. 12B, and a bath can be taken. After taking a bath, one can push on the upper end of the drain stopper to move it into its open position shown in FIG. 12A. The bath water typically includes hair. As the water drains from the bathtub, the water flows into an annular space 154*e* defined between the inside wall 154*c* of the drain pipe 154 and the outside surface of the strainer body 156*a*. The water then flows into the strainer basket 156 through openings 156*d* in the body 156*a* of the strainer 156. Hair and other debris and objects tend to be caught on the outside surface of the strainer body 156*a* in the annular space 154*e*. Water flows downwardly into drain pipe 154 through the openings 158*c* in the disk 158 and through the openings 154*f* in the cross-bars 154*b*. Since the drain stopper 150 rests on the cross-bars 154*b* in the drain pipe 154, the stopper 150, the strainer 156 and the disk 158 can be pulled as a combined assembly out of the drain pipe 154. Hair, debris and objects can be removed from outside the strainer body 156*a*, and the strainer can be re-inserted into the drain pipe 154 for re-use. If the washer-shaped gasket 156*c*' is not included in the assembly, some water and debris may flow into the inside of the strainer 156, but it is believed that strainer 156 will still be sufficiently effective in removing hair and debris and objects from the water. Some of the hair, debris and objects may be caught inside the strainer rather than more exclusively on the outside of the strainer. The embodiment shown in FIGS. 12A and 12B provides a fully functional push-push drain stopper with a strainer basket that can be easily removed from the drain for cleaning the strainer. Other strainers disclosed herein and disclosed in patent documents that are incorporated by reference can be used instead of strainer 156. In addition, the cap 150*a*, with its large and decorative drain cover 150*c*, covers and hides the drain flange 154*a*, which allows one to hide a drain flange that has become undesirable in its appearance, possibly due to wear or damage or due to a color that one desires to change. The diameter of the decorative drain cover 150*c* is at least equal to the outermost diameter of the drain flange 154*a*, preferably greater than the diameter of the drain flange. The outermost diameter of the decorative drain cover 150*c* may be 5-50% or 5-25% greater than the outermost diameter of the drain flange 154*a*.

It is possible to use a lift-and-lock mechanism or a lift-and-turn mechanism instead of the push-push mechanism 150*e* for opening and closing a drain stopper according to the present invention. These and any other open-and-close mechanism can be fitted with the strainer 156 and the disk 158. The drain stopper can rest on the cross-bars 154*b*, but if opening the drain stopper tends to pull the stopper out of the drain pipe 154 when not desired, then the gasket 160 on the perimeter of the disk 158 can be re-designed to provide sufficient friction to stay in place during routine opening of the drain stopper, and yet be pulled out for cleaning when desired. A drain stopper with a push-push mechanism, a lift-and-lock mechanism or a lift-and-turn mechanism can be fastened to the cross-bars 154*b*, such as by the methods disclosed in the 20170314245 application incorporated above.

Figures 13A, 13B, 13C, 13D:
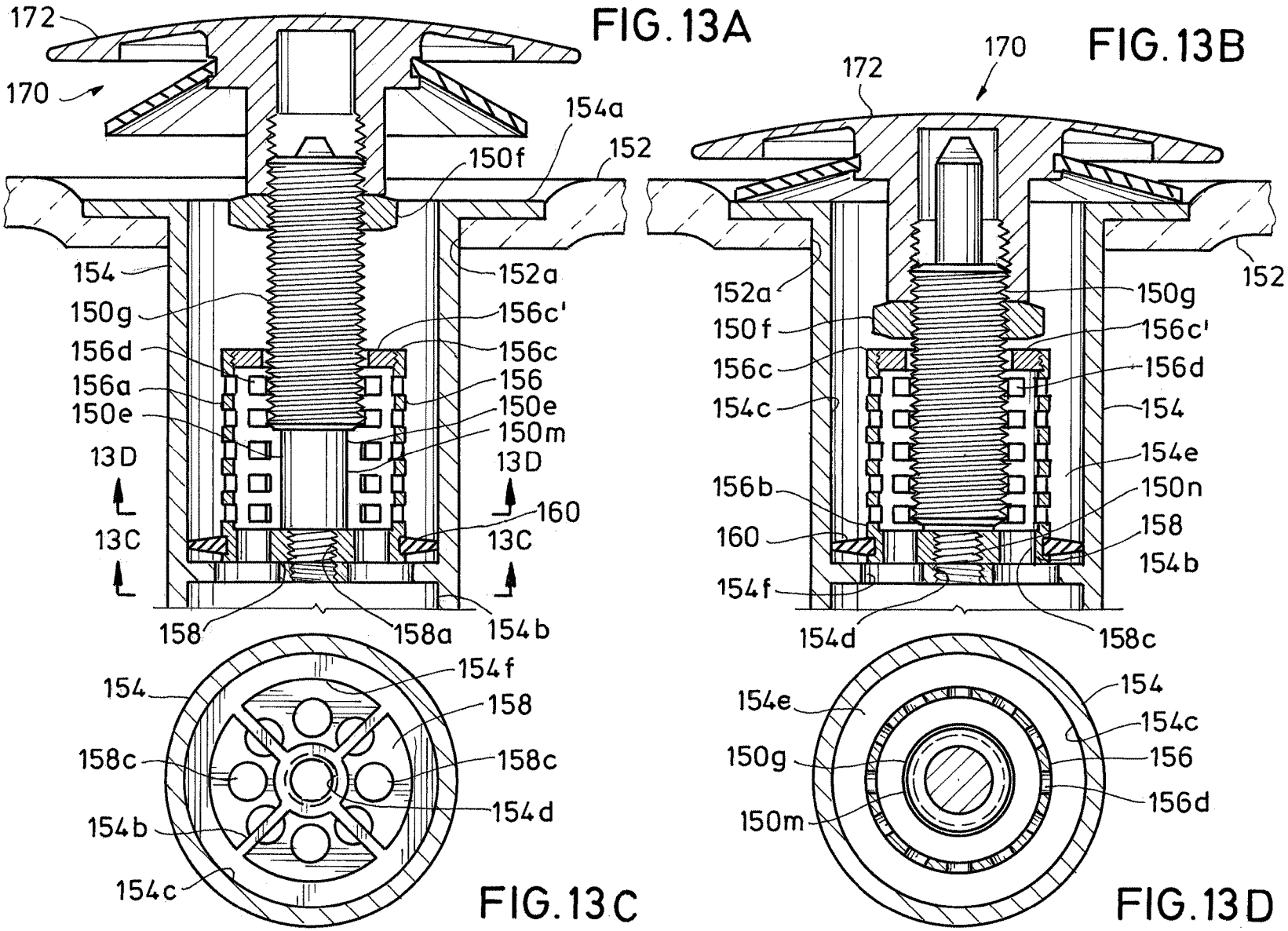
FIG. 13A is a side elevation in cross-section of a bathtub drain stopper and drain flange cover with a strainer basket, which is in its open position, according to the present invention.
FIG. 13B is a side elevation in cross-section of a bathtub drain stopper and drain flange cover of FIG. 13A in its closed position.
FIG. 13C is a cross-section of the bathtub drain stopper and drain flange cover of FIG. 13A as seen along the line 13C-13C.
FIG. 13D is a cross-section of the bathtub drain stopper and drain flange cover of FIG. 13A as seen along the line 13D-13D.

FIGS. 13A and 13B are side elevations in cross-section of a drain stopper 170 for the bathtub 152, which has the drain opening 152*a* and the drain pipe 154 and the drain flange 154*a* sealed about the drain opening 152*a*. FIG. 13A shows drain stopper 170 in an open position, and FIG. 13B shows drain stopper 170 in a closed position. The only significant difference between drain stopper 170 in FIGS. 13A and 13B and drain stopper 150 in FIGS. 12A and 12B is that drain stopper has a smooth, dome-shaped decorative cap 172. Other elements of drain stopper 170 are the same as for drain stopper 150, and the element numbers and explanations for drain stopper 150 are the same as for drain stopper 170.

FIG. 13C is a cross-section of drain stopper 170 as seen along the line 13C-13C in FIG. 13A. FIG. 13C is particularly helpful for seeing the cross-bars 154*b*, its central bore 154*d*, and its openings 154*f*. One can also see the underside of the disk 158 through the openings 154*f* in the cross-bars 154*b*. One can see the plurality of openings 158*c* in the disk 158 through the openings 154*f* in the cross-bars 154*b*. FIG. 13D is a cross-section of drain stopper 170 as seen along the line 13D-13D in FIG. 13A. One can see the strainer 156 and the push-push mechanism 150*e* in cross-section.

Drain stoppers 150 and 170 can also be used in a bathroom sink or basin. The present inventors' related U.S. Patent Application Pub. No. 20170314244 A1, application Ser. No. 15/584,030, which is incorporated by reference in its entirety for all purposes, discloses a push-type drain stopper that can be used in a bathroom sink or basin that has a pop-up drain assembly with a pivot rod. The push-type drain stopper in the '4244 publication attaches to or rests on a rod that protrudes into the drain pipe through a pivot rod port. The disk 158 in drain stoppers 150 and 170 rests on the cross-bars 154*b*. With little or no modification, the disk 158 could instead rest on a rod protruding into a drain pipe for a bathroom sink or basin. FIG. 4 in the '4244 publication discloses a strainer that catches hair and debris inside a strainer basket. Drain stoppers 150 and 170 of the present invention use the strainer 156, which catches hair and debris on the outside of the strainer. Strainer 156 and disk 158 can be incorporated into the push-type drain stopper in the '4244 publication. One would then have a push-type drain assembly for a sink having a drain opening, comprising:

a drain pipe attached to the sink at the drain opening, wherein the drain pipe has a port and a stub surrounding the port, wherein the drain pipe has a longitudinal axis, and wherein the stub has a longitudinal axis that is transverse to the longitudinal axis of the drain pipe;

a rod passing through the port and protruding into the drain pipe, wherein the rod is fastened directly or indirectly to the stub, wherein the rod has a longitudinal axis that is transverse to the longitudinal axis of the drain pipe;

a push-type drain stopper received in the drain pipe and supported by the rod, wherein the drain stopper comprises a push-push mechanism that holds the drain stopper in one of two positions, wherein the two positions are an open position and a closed position, wherein the drain stopper has opposing upper and lower ends, wherein a push on the upper end of the drain stopper moves the drain stopper from the open position to the closed position and another push on the upper end of the drain stopper moves the drain stopper from the closed position back to the open position; and preferably a disk on the lower end of the drain stopper that rests on the rod, preferably wherein the disk has one or more openings, preferably further comprising a strainer basket around the push-push mechanism for catching hair, debris and objects on an outside surface of the strainer basket while water flows into the strainer basket and out through the one or more openings in the disk.

The drain assembly for a bathroom sink may be different from the drain pipe from a bathtub, but the drain stoppers 150 and 170 described for use in a bathtub can also be used retrofit a pop-up drain assembly in a bathroom sink that has a pivot rod protruding into a drain pipe through a pivot rod port. One can remove the drain stopper in the bathroom sink and replace it with drain stopper 150 or 170, thereby retrofitting the drain assembly to a push-to-open and push-to-close type of drain stopper, while continuing to use the existing drain pipe and pivot rod. A control rod that was previously used to move the stopper up and down would no longer be needed. Drain stopper 150 or 170 can be modified to include a two-prong fork on the lower end of the drain stopper for anchoring the drain stopper to a rod that protrudes into the drain pipe through a pivot rod port. The two-prong fork has a pair of parallel tines that are separated by a gap, and the rod is received in the gap in a tight fit with the tines. The two-prong fork is pressed transversely onto the rod. The diameter of the drain flange cover may typically range from 1.75 inches to 2.50, 2.75 or 3.00 inches, depending on the size of the drain flange to be covered. The diameter of the drain flange cover may be typically at least 0.50 to 1.00 inch greater than the diameter of the gasket, assuming the diameter of the gasket is the same as the inside diameter of the drain pipe and that the drain flange extends 0.25 to 0.50 inch beyond the inside diameter, in order for the drain flange cover to cover and hide the drain flange. The diameter of the drain flange cover for a drain flange in a bathroom sink is preferably about 2.5 inches.

Figure 14:
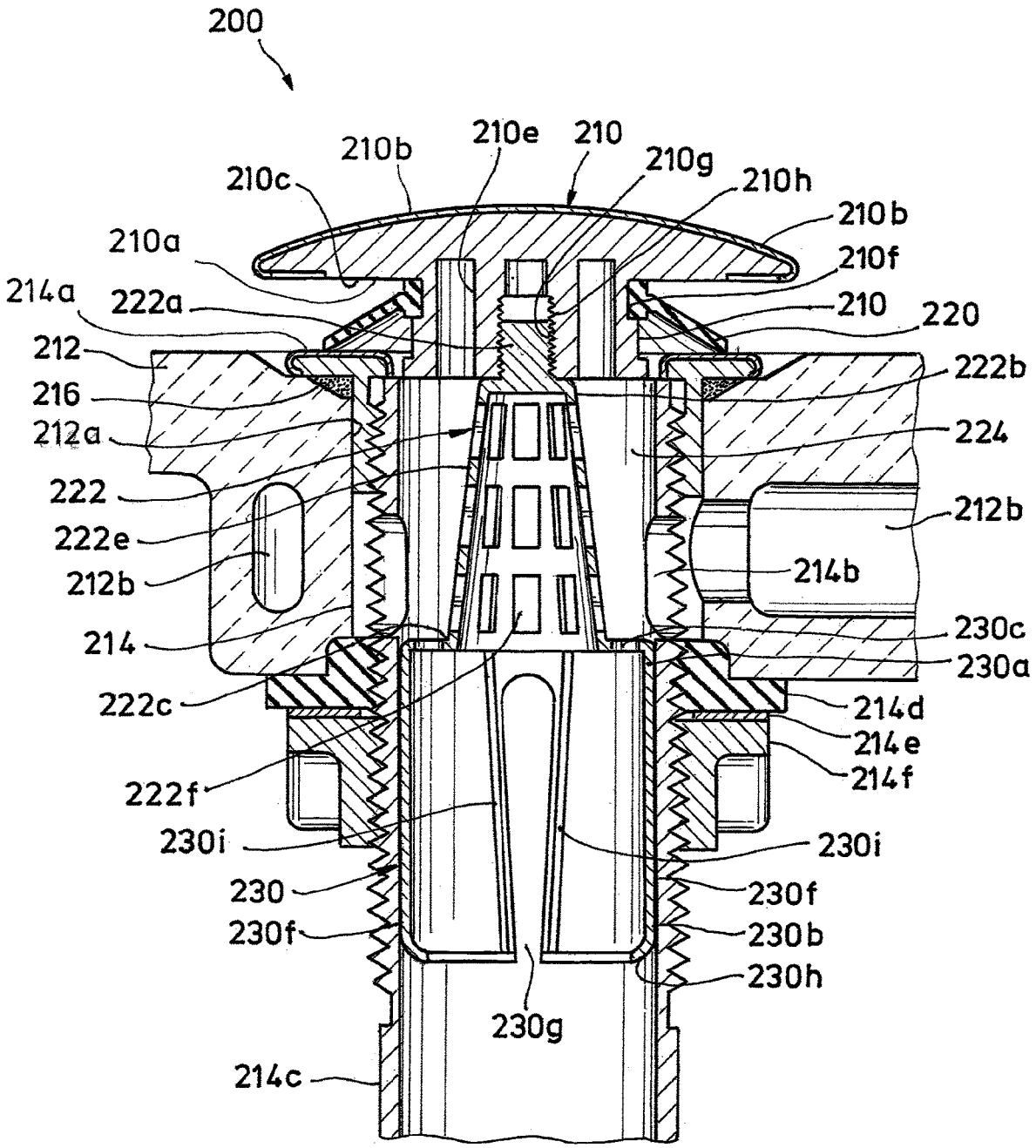
FIG. 14 is a side elevation in partial cross-section of a combined drain stopper and strainer, according to the present invention, in a drain pipe.

Turning now to the CIP application, FIG. 14 is a side elevation in cross-section of a manually-operated, combined drain stopper and strainer 200 received in a bathroom sink, a kitchen sink or a bathtub 212, which has a drain opening 212*a*. A drain pipe 214 is received in the drain opening 212*a* and has a drain flange 214*a* that extends radially outwardly from the longitudinal axis of the drain pipe 214 and rests on an upper surface of the sink or bathtub 212. A plumber's putty or gasket 216 seals a lower surface of the drain flange to the upper surface of the sink or bathtub 212 around the drain opening 212*a*. The drain stopper and strainer 200 has a cap 210 on an upper end, which has a dome-shaped structure 210*a* that has a convex upper and outer surface 210*b* with respect to the longitudinal axis of the drain pipe 214. The sink 212 in FIG. 14 is representative of a bathroom sink, but the combined drain stopper and strainer 200 can also be used in a kitchen sink, a bathtub and in other drain openings, such as in a floor drain. Sink 212 has overflow ports 212*b*, and drain pipe 214 has overflow ports 214*b* aligned with the overflow ports 212*b*. Drain pipe 214 has a lower end 214*c* opposing the flanged upper end 214*a*. A gasket 214*d*, a washer 214*e* and a nut 214*f* are used to fasten the drain pipe 214 to the sink 212. Manually-operated means that one holds the cap 210; pulls to remove the stopper/strainer 200 from the drain pipe 214 or to place the stopper/strainer 200 in an open position so that water will drain from the sink or bathtub 212; and pushes the stopper/strainer 200 downward to place the stopper/strainer 200 in a closed position to seal water in the sink or bathtub 212.

Cap 210 has a lower surface 210*c*. An outer tubular structure 210*d* and an inner tubular structure 210*e* depend downwardly from the lower surface 210*c*. The outer tubular structure 210*d* has a groove or indentation 210*f*, and a gasket or seal 220 is received in the groove or indentation 210*f*. Seal 220 rests against the drain flange 214*a* to provide a closed position and is spaced away from the drain flange 214*a* while in an open position. Alternatively, the cap and seal described with reference to FIG. 7 can be used. The inner tubular structure 210*e* has a bore 210*g* defined by female threads 210*h*. Cap 210 can have a different shape, such as the shape of other caps shown herein, and can have a decorative sheet covering its upper and outer surface as described herein.

A strainer 222 has a stud 222*a* with male threads on an upper end 222*b*. Stud 222*a* is threaded into the bore 210*g* in the cap 210, which fastens the strainer 222 to the cap 210. Other forms of attachment can be used including a press fit, a snap fit, a detent, a reversal of the male and the female threads, and the strainer 222 can be formed integral with the cap 210. Strainer 222 has a lower end 222*c*. The ends 222*b* and 222*c* have diameters, and in this embodiment, the lower end 222*c* has a greater diameter than the upper end 222*b*. The strainer 222 is shown as having an inverted frustoconical shape. However, which end has the greater diameter can be reversed, and a cylindrical shape can be used. The strainer 222 is illustrated as one that catches hair and debris on an outside surface as water flows from an annular space 224 between the outside surface of the strainer 222 and an inside surface of the drain pipe 214 into an inner space 222*d* within the strainer defined by a wall 222*e* of the strainer. Alternatively, a strainer that catches hair and debris inside the strainer, such as illustrated in FIGS. 5A and 8A, can be used. The wall 222*e* of the strainer has a cylindrical or conical shape or another shape, such as a cross-section that is hexagonal. The wall 222*e* has a plurality of openings 222*f* through which water can drain or pass.

A gripping element 230 depends downwardly from the lower end 222*c* of the strainer 222 while installed in the drain pipe 214. Gripping element 230 can be engaged with the strainer 222 by various means such as by threading, but is shown as being formed integral with the strainer 222. Gripping element 230 is shown in FIG. 14 as having a generally cylindrical shape with an upper or first end 230*a* and an opposing lower or second end 230*b*. Upper end 230*a* comprises an annular or washer-shaped plate 230*c*, which has a central opening 230*d* that can be seen in a bottom view in FIG. 16. The lower end 222*c* of the wall 222*d* of the strainer 222 surrounds the central opening 230*d* in the gripping element 230, and water can drain from within the strainer through the central opening 230*d*. The annular plate 230*c* has a plurality of holes 230*e* for allowing water to drain from the annular space 224 into and through the gripping element 230. The holes 230*e* can be seen in FIGS. 16 and 18.

Gripping element 230 has three longitudinal wall segments 230*f* separated by three longitudinal notches 230*g*. Notches 230*g* extend from the lower or second end 230*b* toward and nearly all the way to the first or upper end 230*a*. The lower or second end 230*b* of the wall segments 230*f* are free, meaning not attached to each other or to anything else. The wall segments 230*f* are joined together at the first or upper end 230*a* of the gripping element 230. The first or upper end 230*a* of the gripping element 230 has the appearance of an upside-down-bowl shape with the annular or washer-shaped plate 230*c* being the closed end of the bowl, although it has openings 230*d* and 230*e*. The notches 230*g* could, but preferably do not, extend all the way from the second end 230*b* to the plate 230*c*. The wall segments 230*f* are shaped somewhat like a feed trough that has a bottom that in cross-section has the shape of the arc of a circle. A cross-section of the wall segments 230*f* have the appearance of a segmented circle. It may be possible to accomplish the purposes of the gripping element 230 without notches and wall segments with the proper resilience of a material and a proper size for a drain pipe, but at least two wall segments separated by at least two notches is a preferred embodiment.

Figure 15:
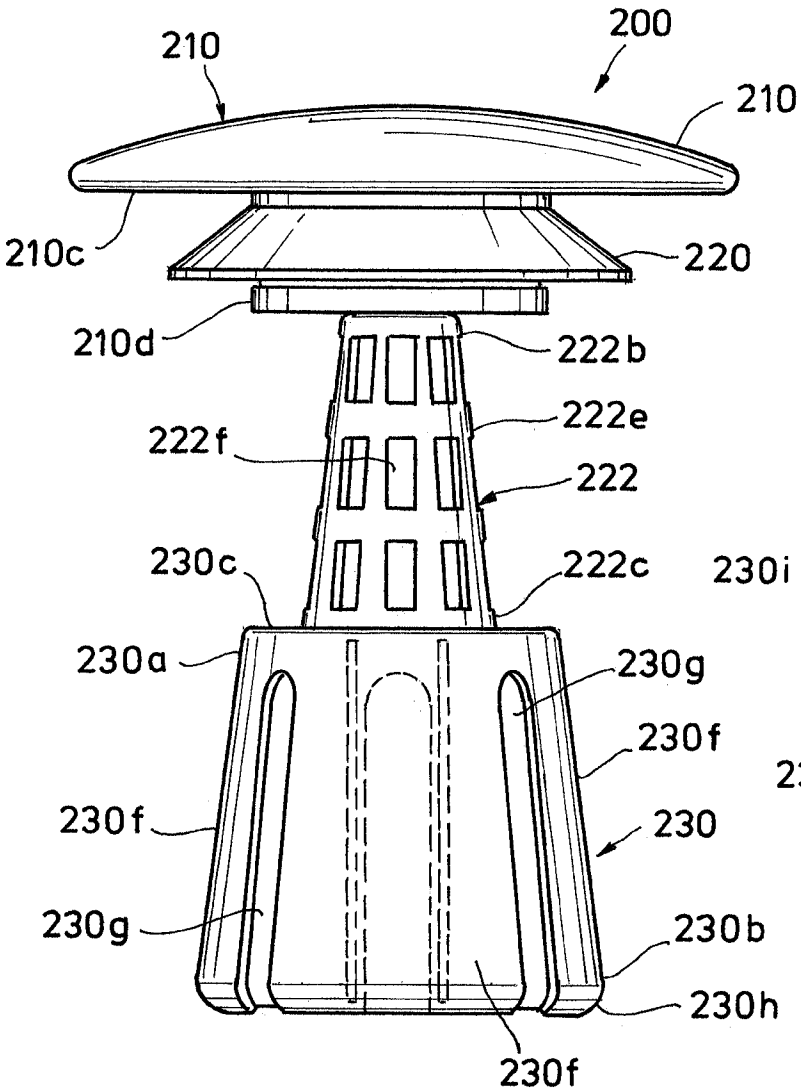
FIG. 15 is a side elevation of the drain stopper and strainer of FIG. 14 after removal from the drain pipe.

FIG. 15 is a side elevation of the drain stopper and strainer 200 after it has been removed from the drain pipe 214. One will notice that the gripping element 230 has a cylindrical shape while installed in the drain pipe 214, as shown in FIG. 14, but a slightly conical shape after it has been removed from the drain pipe 214, as shown in FIG. 15. Gripping element 230 is preferably made of a resilient material, preferably a polymeric material. A person can grip the wall segments 230*f* and squeeze the wall segments closer together, reducing the width of the notches 230*g*, in order to place the gripping element 230 inside the drain pipe 214. The person can then release the wall segments 230*f*, and the wall segments will spring radially outwardly because the gripping element 230 is made of a resilient material. Drain pipes for bathroom sinks typically have an inside diameter of 1.25 or 1.50 inches. The gripping element 230 is preferably made for this application to fit both the 1.25 inch and the 1.50 inch diameter. After placement inside the drain pipe 214, the wall segments 230*f* of the gripping element 230 spring radially outwardly and grip the inside wall of the drain pipe 214, thereby holding the gripping element 230 and the drain stopper/strainer 200 in place until the person pushes down on the cap 210 to engage the seal 220 with the drain flange 214*a* or pulls up on the cap 210, presumably to release water held in the sink or bathtub 212. Gripping element 230 also tends to center the strainer 222 in the drain pipe 214. It should also be noted that the second end or lower end 230*b* of the gripping element 230 has an inwardly curved lowermost end 230*h*, which provides a rounded shape. The purpose of the rounded shape on the lowermost end 230*h* is to inhibit or prevent the gripping element 230 from catching on the wall of the drain pipe 214 at the overflow ports 214*b* as the gripping element is pushed downwardly through the drain pipe 214.

The gripping element 230 serves at least three purposes: (1) the gripping element 230 provides a surface that a person can grip, hold and squeeze to reduce the diameter of the gripping element for inserting the gripping element 230 in the drain pipe 214; (2) the gripping element 230 expands radially outwardly inside the drain pipe 214 and grips the inside surface of the wall of the drain pipe 214, thereby holding the gripping element in place, but also allowing a person to slide the gripping element up or down in the drain pipe to open or close the drain stopper; and (3) the gripping element 230 tends to centralize the strainer 222 within the drain pipe 214, thereby giving a good and proper appearance for the cap 210 centered over the drain flange 214*a*. It is believed that the gripping element 230 functions best if it has a somewhat long length with respect to the overall length of the drain stopper/strainer 200, possibly from ten to fifty percent of the overall length or twenty to forty percent. In the embodiment illustrated in FIGS. 14 and 15, the length of the gripping element 230 is approximately equal to the length of the strainer 222.

Figure 16:
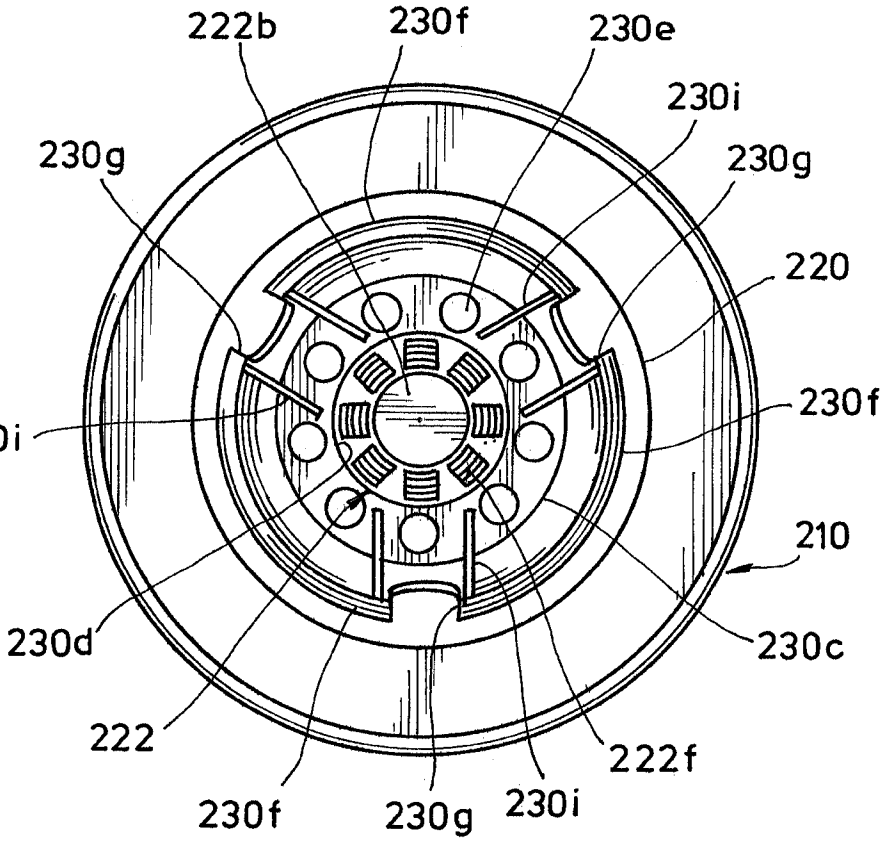
FIG. 16 is a bottom view of the drain stopper and strainer of FIG. 15.
Figure 18:
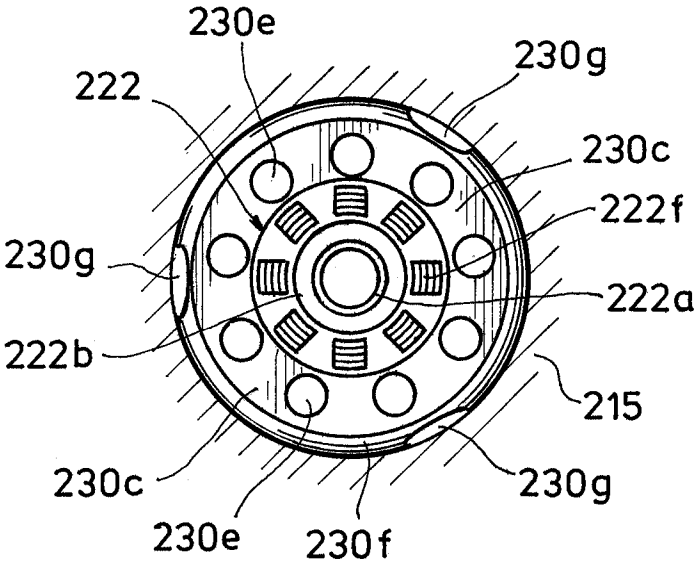
FIG. 18 is a top view of FIG. 17.
Figure 17:
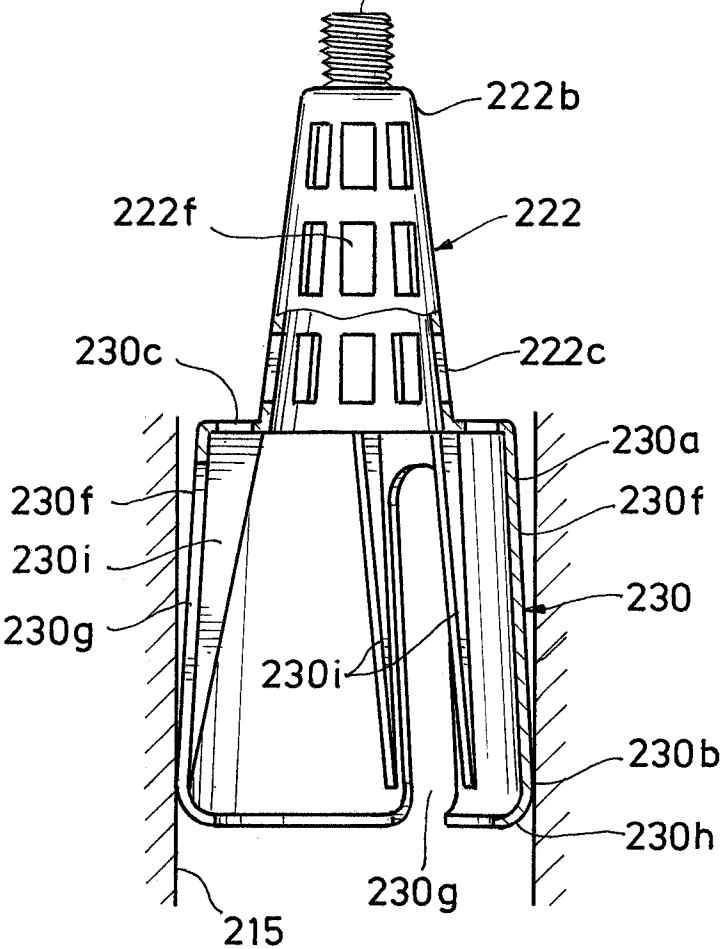
FIG. 17 is a side elevation in partial cross-section of the drain stopper and strainer of FIG. 15, without its cap and in a drain pipe that is larger than the one in FIG. 14.

FIG. 16 is a bottom plan view of the of the drain stopper/strainer 200 of FIG. 15. FIG. 17 is a side elevation in partial cross section of the strainer 222 and the gripping element 230 in a drain pipe 215. The drain pipe 215 in FIG. 17 has a larger inside diameter than the drain pipe 214 in FIG. 14. The gripping element 230 expands radially outwardly and grips the inside wall of the drain pipe 215, but does not fit as tightly as in the smaller inside diameter pipe 214 in FIG. 14. The gripping element 230 can be sized and designed to fit in and function as intended in drain pipes having different diameters, particularly in bathroom sink drain pipes having inside diameters of 1.25 and 1.50 inches. FIG. 18 is a top plan view of the drain pipe 215, the strainer 222 and the gripping element 230 shown in FIG. 17.

Gripping element 230 is preferably somewhat rigid in addition to being resilient. Gripping element 230 is preferably made of a polymeric material that is somewhat rigid, as opposed to a soft, rubbery material, because it should to be able to grip drain pipes of two different sizes, such as drain pipes 214 and 215, and should be able to hold the seal 220 in a position in which it is placed. With reference to FIG. 17, stiffening braces 230*i* are included along each edge of the notches 230*g*. Each of the six stiffening braces 230*i* is a plate of material that has the approximate shape of a right triangle. The narrow base of the triangle is mounted to the underside of the annular plate 230*c*, and the longer side of the right angle is mounted along the edge of a notch 230*g*. The combined strainer 222 and gripping element 230 shown in FIG. 17 is preferably formed in a mold as a single, unitary article of manufacture. The stiffening braces 230*i* add a great deal of rigidity to the gripping element 230.

The drain stopper/strainer of FIGS. 14-18 can be described as a drain stopper and strainer for a drain opening and a drain pipe that has a drain flange and components for sealing around the drain opening. The drain stopper and strainer includes a cap; a seal engaged with the cap for providing a seal with the drain flange or the drain pipe; a strainer having upper and lower ends, where the upper end is engaged with the cap, where the strainer has a plurality of openings through which water can flow, and where hair, debris and objects in the water tend to be caught by the strainer; and a gripping-and-centering element attached to or formed integral with the lower end of the strainer, where the gripping-and-centering element has opposing top and bottom ends, where the top end is attached to or formed integral with the lower end of the strainer, where the gripping-and-centering element has a generally tubular shape with longitudinal notches so as to have a segmented annular shape, and where the gripping-and-centering element is resilient and sized to grip an inside wall of the drain pipe. The gripping-and-centering element tends to center the strainer within the drain pipe and has sufficient surface area for a person to grasp and squeeze the gripping-and-centering element for placing the gripping-and-centering element within the drain pipe after which the gripping-and-centering element springs outwardly and engages the inside wall of the drain pipe.

The cap, the gripping-and-centering element and the strainer are sized and designed for a person to grasp the cap and slide the gripping-and-centering element and the strainer down and up in the drain pipe between a position in which the seal is engaged with the drain flange for providing a closed position and a position in which the seal is spaced away from the drain flange for providing an open position. In one embodiment, the cap has a diameter at its widest point, and the seal has a diameter at its widest point, where the diameter of the cap is greater than the diameter of the seal. The gripping-and-centering element can be described as a segmented, annular gripping and centering element, which one can grip and squeeze to insert the same into a drain pipe, which then presses against an inside surface of the drain pipe by spring action to hold the stopper/strainer in place, which tends to center the stopper/strainer in the drain pipe, and which tends to hold the stopper/strainer in an upright position.

Figure 19:
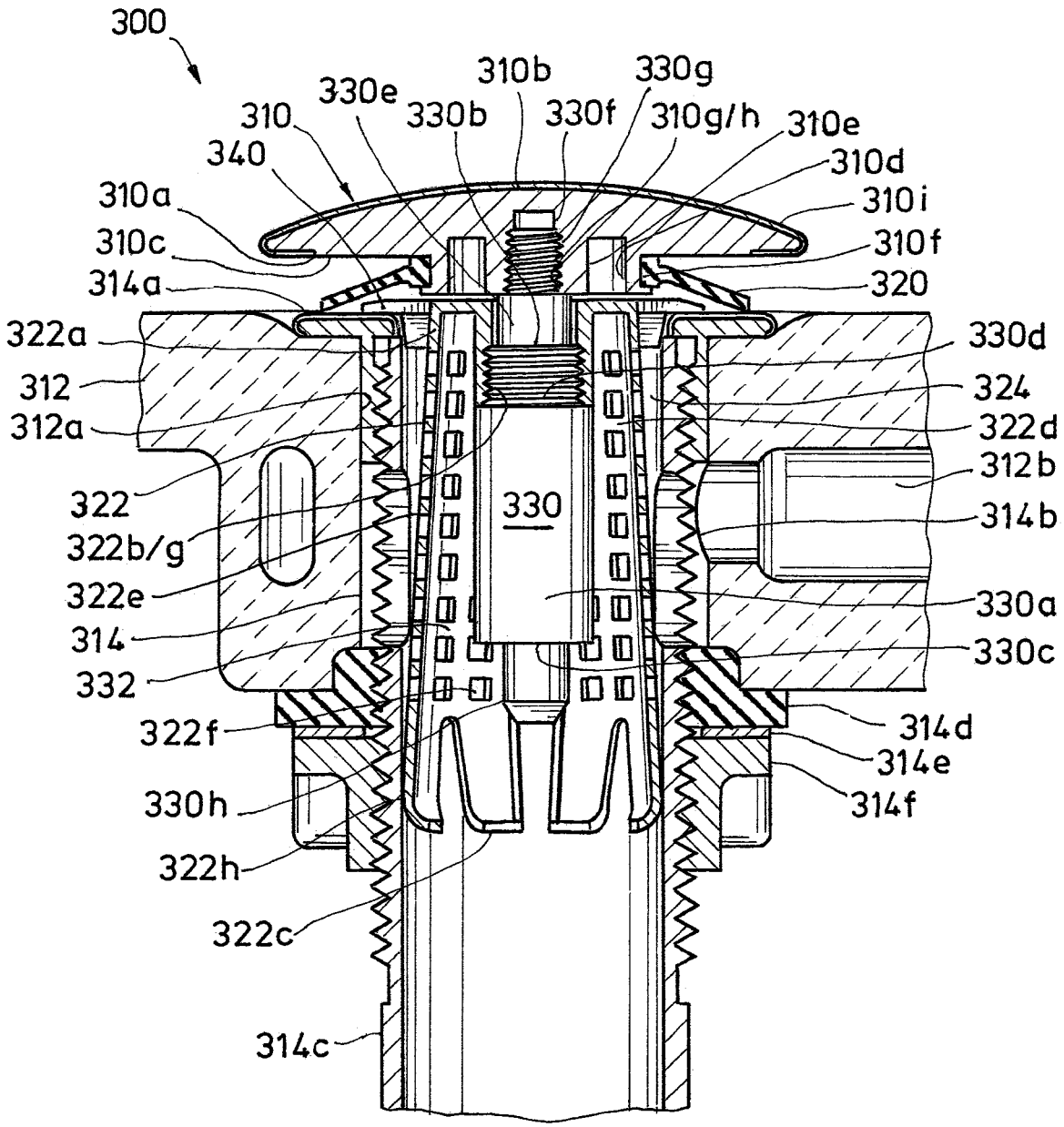
FIG. 19 is a side elevation in cross-section of a drain stopper in a drain pipe, according to the present invention.

Turning now to another embodiment of the present invention in the CIP application, FIG. 19 is a side elevation in cross-section of a drain stopper 300 received in a bathroom sink, a kitchen sink or a bathtub 312, which has a drain opening 312*a*. A drain pipe 314 is received in the drain opening 312*a* and has a drain flange 314*a* that extends radially outwardly from the longitudinal axis of the drain pipe 314 and rests on an upper surface of the sink or bathtub 312. A plumber's putty or gasket, such as element 216 in FIG. 14, can be used to seal a lower surface of the drain flange to the upper surface of the sink or bathtub 312 around the drain opening 312*a*. The drain stopper and strainer 300 has a cap 310 on an upper end, which has a dome-shaped structure 310*a* that has a convex upper and outer surface 310*b* with respect to the longitudinal axis of the drain pipe 314. The sink 312 in FIG. 19 is representative of a bathroom sink, but the drain stopper 300 can also be used in a kitchen sink, a bathtub and in other drain openings, such as in a floor drain. Sink 312 has overflow ports 312*b*, and drain pipe 314 has overflow ports 314*b* aligned with the overflow ports 312*b*. Drain pipe 314 has a lower end 314*c* opposing the flanged upper end 314*a*. A gasket 314*d*, a washer 314*e* and a nut 314*f* are used to fasten the drain pipe 314 to the sink 312. One holds the cap 310 and pushes the stopper/strainer 300 down into the drain pipe 314 to place the stopper/strainer 300 into its operating position.

Cap 310 has a lower surface 310*c*. An outer tubular structure 310*d* and an inner tubular structure 310*e* depend downwardly from the lower surface 310*c*. The outer tubular structure 310*d* has a groove or indentation 310*f*, and a gasket or seal 320 is received in the groove or indentation 310*f*. Seal 320 rests against the drain flange 314*a* to provide a closed position and is spaced away from the drain flange 314*a* while in an open position. The inner tubular structure 310*e* has a bore 310*g* defined by female threads 310*h*. Cap 310 can have a different shape, such as the shape of other caps shown herein, and can have a decorative sheet 310*i* covering its upper and outer surface as described herein.

Drain stopper 300 preferably, but optionally, includes a strainer 322, which has an upper end 322*a*. The upper end 322*a* is molded with a radially inward bend and a longitudinally downward bend to provide an inner tubular element 322*b* having a bore 322*b*, which is defined by female threads 322*g*. The upper end 322*a* thus has the inner tubular element 322*b*, which is concentric within an outer tubular element, which is the outer wall of the strainer, and an annular space is defined between the outer wall of the strainer and the inner tubular element 322*b*. The inner tubular element 322*b* is coaxial with the longitudinal axis of the strainer 322. Strainer 322 has a lower end 322*c*, which is bent radially inwardly for making it easier to insert the drain stopper 300 into the drain pipe 314, since the curved end 322*c* is less likely to catch on the drain flange 314*a* than if it were a straight, blunt end. The ends 322*b* and 322*c* have diameters, and in this embodiment, the lower end 322*c* has a greater diameter than the upper end 322*b*. The strainer 322 is shown as having an inverted frustoconical shape. However, which end has the greater diameter can be reversed, and a cylindrical shape can be used. The strainer 322 is illustrated as one that catches hair and debris on an outside surface as water flows from an annular space 324 between the outside surface of the strainer 322 and an inside surface of the drain pipe 314 into an inner space 322*d* within the strainer defined by a wall 322*e* of the strainer. The wall 322*e* has a plurality of openings 322*f* through which water can drain or pass. Alternatively, a strainer that catches hair and debris inside the strainer, such as illustrated in FIGS. 5A and 8A, can be used. The wall 322*e* of the strainer has a cylindrical or conical shape or another shape, such as a cross-section that is hexagonal. Any of the shapes illustrated herein for a strainer or any other shape can be used.

A push-push type of open-close mechanism 330 has an outer cylindrical, tubular body 330*a*, which has an upper end 330*b* and a lower end 330*c*. The upper end 330*b* has male threads 330*d*, which are in threaded engagement with the female threads 322*g* that define the bore 322*b* in the strainer 322, thereby fastening the push-push mechanism 330 to the strainer basket 322. It is conceivable that a reverse threading arrangement can be used. This threading arrangement can be reversed, and a connection other than threading can be used, such as press fit, snap fit, interlock fit, formed integral together or a glued fitting. Any of these various means can be used to engage the open-close mechanism 330 with the strainer basket 322. The open-close mechanism 330 has an inner cylindrical, tubular body 330*e*, which has an upper end 330*f*, which has male threads 330*g*, and a lower end 330*h*. The male threads 330*g* are in threaded engagement with the female threads 310*h* in the bore 310*g* in the cap 310. This threading arrangement can be reversed, and a connection other than threading can be used, such as press fit, snap fit, interlock fit, formed integral together or a glued fitting. Any of these various means can be used to engage the open-close mechanism 330 with the cap 310.

The push-push type of open-close mechanism 330 is known as a push-type drain assembly, which is used in a push-push drain stopper. A first push downwardly on the top of a drain stopper moves the stopper into a closed position. A second push moves the stopper into an open position. U.S. Pat. No. 3,220,695, issued to Downey et al. on Oct. 13, 1961, describes what is titled as a "Push-Button Drain Valve." U.S. Pat. No. 3,366,980, issued to Petursson et al. on Apr. 16, 1965, describes a different push-type drain stopper. U.S. Pat. No. 10,301,803, issued to Beck and Ahuja on May 28, 2019, describes a push-type drain stopper for a pop-up drain and is incorporated by reference. The Pfister plumbing company sells a drain assembly called Push & Seal as an alternative to a pop-up drain assembly. The Push & Seal drain assembly has a drain pipe that is received in a sink drain opening, a gasket and nut for sealing the drain pipe in the sink, and a push-type drain stopper that is received in the drain pipe in a threaded engagement with the drain pipe. The push-push type of open-close mechanism 330 is one embodiment of the present invention, but alternative open-close mechanisms, such as a lift and lock open-close mechanism and a lift and turn open-close mechanism, can be used.

The strainer basket 322 surrounds the open-close mechanism 330, and an annular space 332 is defined between an outside surface of the outer body 330*a* and an inside surface of the strainer basket 322. In this embodiment, the lower end 322*c* of the strainer 322 extends below the lower end 330*h* of the open-close mechanism 330, although that is not necessary. A wall section 322*h* is adjacent to the lower end 322*c* of the strainer 322. The strainer 322 is sized and designed so that the wall section 322*h* presses against an inside surface of the drain pipe 314, thereby providing a seal, which causes water to flow through the openings 322*f* and into the annular space 332, so that hair, debris and objects in the water tends to be caught on the outside surface of the strainer basket 322.

Figure 21:
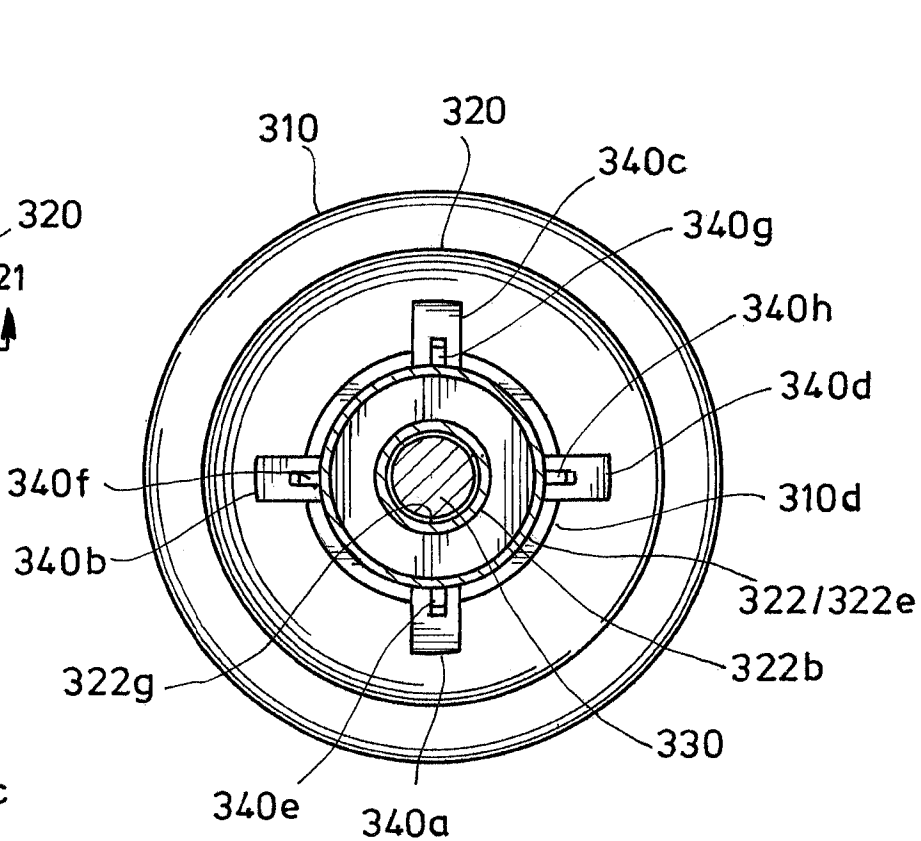
FIG. 21 is a cross-section of the drain stopper of FIG. 20, as seen along the line 21-21 in FIG. 20.
Figure 20:
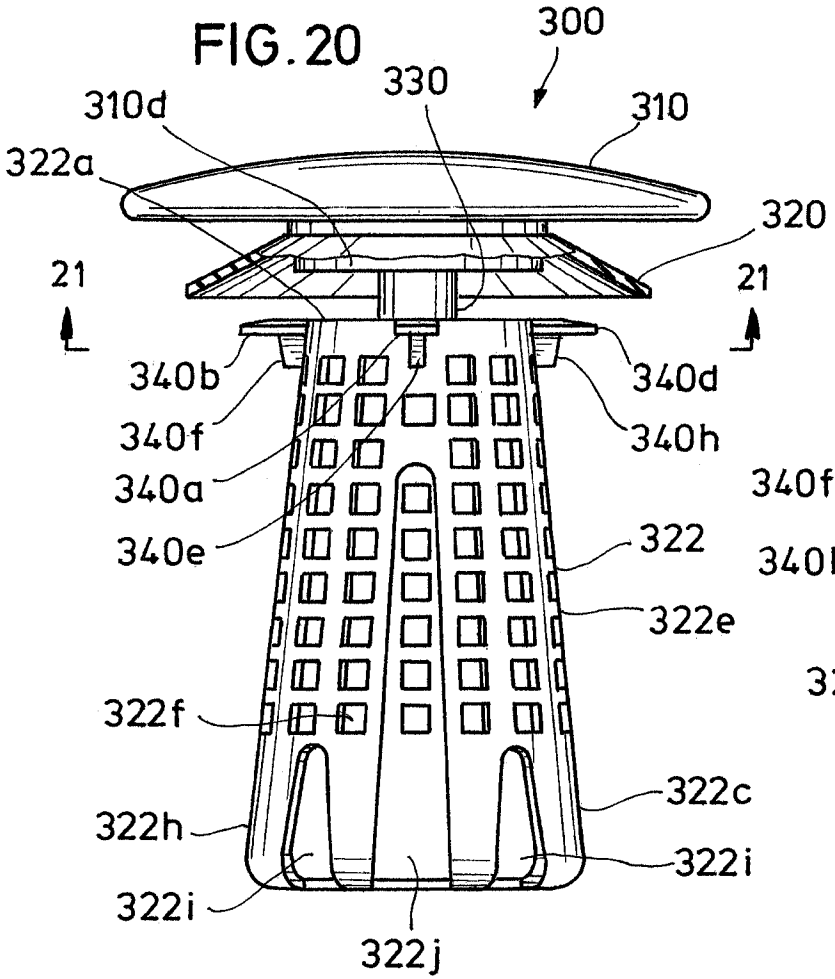
FIG. 20 is a side elevation of the drain stopper of FIG. 19 removed from the drain pipe.
Figure 23:
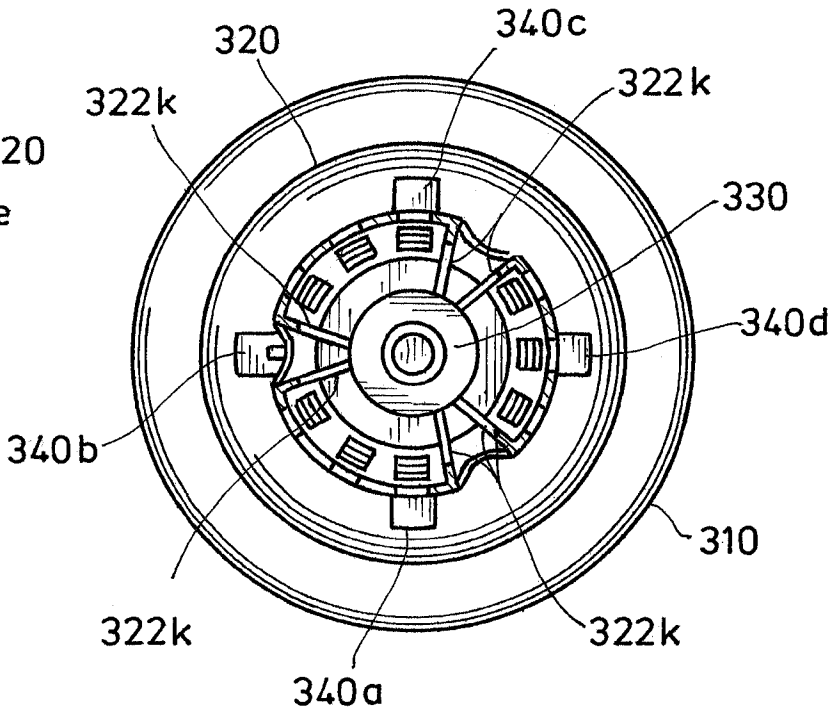
FIG. 23 is a cross-section of the drain stopper of FIG. 22, as seen along the line 23-23 in FIG. 22.
Figure 22:
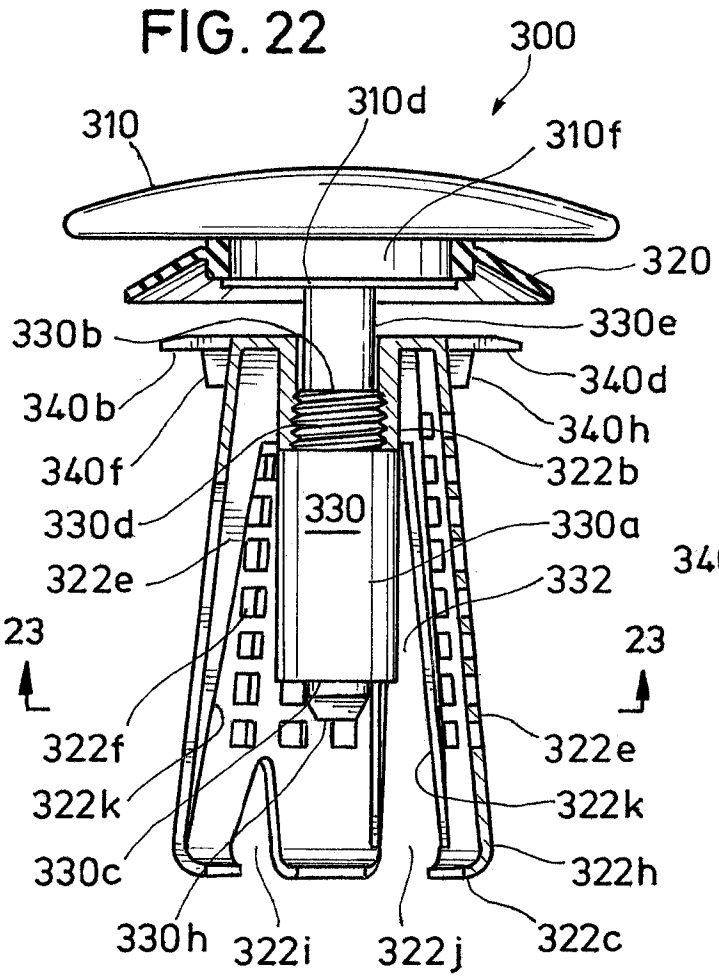
FIG. 22 is a partial cross-section of the drain stopper of FIG. 20.

This embodiment of the invention includes a means for holding the drain stopper 300 in the drain pipe 314. One possible means is a set of prongs 340. Prongs 340 can be seen better in FIGS. 20-23, where FIG. 20 is a side elevation of the drain stopper 300 removed from the bathroom sink, kitchen sink or bathtub 312. FIG. 21 is a cross-section of the drain stopper 300, as seen along the line 21-21 in FIG. 20. FIG. 22 is a partial cross-section of the drain stopper 300 in FIG. 20. FIG. 23 is a cross-section of the drain stopper 300, as seen along the line 23-23 in FIG. 22. A set of four prongs 340*a*, 340*b*, 340*c* and 340*d* is one means for holding the drain stopper 300 in the drain pipe 314, where the prongs 340*a-d* rest on an upper surface of drain flange 314*a*. One, two, three, four, five or more prongs can be used. The purpose of the means for holding the drain stopper 300 in the drain pipe 314 is as stated; something, which is the means, should maintain the drain stopper 300 in the drain pipe 314 so that a first push on the cap 310, which is attached to the push-push open-close mechanism 330, will seat the seal 320 on the drain flange 314*a* to provide a closed position for the drain stopper 330 and a second or subsequent push on the cap 310 will lift the seal 320 off the drain flange 314*a* to provide an open position for the drain stopper 330. A radial, annular flange on the upper end 322*a* of the strainer basket 322 would be a suitable means, since the annular flange would rest on the drain flange 314*a*. Strainer basket 322 could have one or more flanges on its longitudinal side wall 322*e* that wedge the strainer basket against the inside wall of the drain pipe 314. Strainer basket 322 could have a regular conical shape rather than an inverted conical shape and have a top portion sized and designed to fir tightly in the drain pipe. Strainer basket 322 could be designed to engage the drain pipe 314 at the port holes 314*b*.

One should be able to remove the drain stopper 300 from the drain pipe 314 easily for cleaning the strainer basket 322. Consequently, the means for holding the drain stopper 300 in the drain pipe 314 does not include a fixed engagement with a pivot rod in a pop-up drain for a sink or a fixed connection to cross bars in a bathtub drain. The means for holding the drain stopper in the drain pipe should allow the drain stopper to rest in the drain pipe in a stable position that allows one to operate the push-push open-close mechanism and allow one to easily pull the drain stopper out of the drain pipe for cleaning hair and debris out of or off of the strainer. A set of two or more prongs is one such means, where the prongs are attached to or formed integral with the strainer basket and preferably located on an upper end of the strainer basket. Another such means is a radial, annular flange attached to or formed integral with the strainer basket and preferably located on an upper end of the strainer basket. Other means are mentioned above. The drain stopper, preferably the strainer portion of the drain stopper, includes means for holding the drain stopper in a stable position in a drain pipe, which allows one to operate an open-close mechanism while also allowing one to easily remove the drain stopper from the drain pipe for cleaning the strainer portion.

In the embodiment of the means illustrated in FIGS. 19-23, the set of four prongs 340*a*, 340*b*, 340*c* and 340*d* are formed integral with the strainer basket 322 and are located at an uppermost end of the strainer basket 322. The prongs 340*a-d* extend radially outwardly far enough to rest on the drain flange 314*a*, but not so far as to interfere with the seating of the seal 320 on the drain flange 314*a*. The radially outermost edges of the prongs circumscribe a circle that has a diameter, which is less than the diameter of the seal, where the seal contacts the drain flange, and the diameter of the circle is greater than the inside diameter of the drain pipe. Each of the four prongs 340*a*, 340*b*, 340*c* and 340*d* has a brace support 340*e*, 340*f*, 340*g* and 340*h*, respectively. The brace supports 340*e-h* strengthen the prongs 340*a-d* for withstanding the force and the wear and tear that results from operating the open-close mechanism 330. The brace supports 340*e-h* also center the drain stopper 300 in the drain flange 314*a*. The brace supports 340*e-h* illustrated are plates that extend radially with respect to the center axis of the drain stopper 300, which are under the prongs 340*a-d*, and which are oriented to have planar sides that extend downwardly and longitudinally with respect to the longitudinal axis of the drain stopper 300. Outer ends of the brace supports 340*e-h* circumscribe a circle that has a diameter, which is slightly smaller than the inside diameter of the drain pipe 314. Drain pipes in bathroom sinks in the U.S.A. typically have inside diameters in the range of 1.0 to 1.5 inches, so the circle may be a little less than 1.0 inch. The prongs 340*a-d* and the brace supports 340*e-h* are preferably formed integrally with the strainer basket 322, which is preferably made by molding a polymeric material such as polypropylene.

Strainer basket 322 is designed and sized so that the lower wall section 322*h* presses against an inside wall of the drain pipe 314. Strainer 322 should be able to flex, bend, be compressed and then expand to contact and press against the inside wall of the drain pipe. As best seen in FIGS. 20 and 22, strainer 322 has a plurality of shallow, V-shaped notches 322*i* that provide openings along the lower edge 322*c*, which openings become narrower away from the lower edge 322*c* toward the upper end 322*a*. Strainer 322 also has a plurality of deep, V-shaped notches 322*j* that provide openings along the lower edge 322*c*, which openings become narrower away from the lower edge 322*c* toward the upper end 322*a*. The V-shaped notches allow the strainer to be compressed to reduce its diameter to fit in a drain pipe, after which the strainer expands and presses against an inside wall of the drain pipe. The shallow, V-shaped notches 322*i* extend less than about one-third the length of the strainer basket 322. The deep, V-shaped notches 322*j* extend about two-thirds of the length of the strainer basket 322. The depth of the deep notches 322*j* is about three times as great as the depth of the shallow notches 322*i* in this embodiment, although any of a variety of strainer baskets can be used. It is not even required that drain stopper 300 have a strainer basket, provided the means for holding the drain stopper in the drain pipe is designed and sized to serve its purpose without using a strainer basket. However, this embodiment has strainer basket 322, which has a brace 322*k* adjacent to each edge of each deep, V-shaped notch 322*j*. The braces 322*k* are plates having a triangular shape that extend from a base under the upper end 322*a* to a point at or near the lower end 322*c*. The braces 322*k* support and strengthen the wall 322*e* and the wall section 322*h*, which presses against the inside wall of the drain pipe 314. The braces 322*k* extend between the inner tubular element 322*b* and the wall 322*e*, thereby strengthening and supporting the inner tubular element 322*b*, as well as the brace supports 340*e-h* and the prongs 340*a-d*. The portion of the strainer basket 322 that is lower than inner tubular element 322*b* in FIG. 22 could be eliminated, leaving the means 340 for holding the drain stopper 300 in the drain pipe 314, where the means 340 would include the prongs 340*a-d*, the brace supports 340*e-h*, the inner tubular element 322*b* for engaging and holding the open-close mechanism 330 and an upper portion of the braces 322*k*, and where the drain stopper is removably engaged with the drain pipe and capable of holding water in a sink or bathtub in a closed position and allowing the water to drain while in an open position.

EMBODIMENTS OF THE INVENTION

Various embodiments of the invention can be described as follows.

1. A drain flange cover for covering a drain flange surrounding a drain opening in a sink or bathtub, comprising:
   - a sheet of material having a circular shape, a diameter suitable for covering the drain flange, a central portion, a perimeter portion along the perimeter of the sheet of material that surrounds the central portion, a top side, a bottom side and a plurality of holes passing through the sheet of material from the top side to the bottom side that make the sheet suitable for use as a strainer; and
   - a layer of glue on the bottom side of the sheet of material on the perimeter portion, wherein there is no glue on the top side of the sheet or on the bottom side within the central portion.

2. The drain flange cover of embodiment 1, wherein the diameter is between one and three inches.

3. The drain flange cover of embodiment 1 or 2, wherein the layer of glue has an annular shape, and wherein the article of manufacture does not have a central, longitudinal shaft extending transverse to the sheet of material.

4. A drain flange cover for covering a drain flange surrounding a drain opening in a sink or bathtub, comprising:
   - a sheet of material having a circular shape, a diameter suitable for covering the drain flange, a central portion, a perimeter portion along the perimeter of the sheet of material that surrounds the central portion, a top side, a bottom side and a plurality of holes passing through the sheet of material from the top side to the bottom side that make the sheet suitable for use as a strainer; and
   - a magnet attached to the bottom side of the sheet of material on the perimeter portion, wherein the magnet has an annular shape, wherein there is no magnet on the top side of the sheet or on the bottom side within the central portion.

5. The drain flange cover of embodiment 4, wherein the diameter is between one and three inches.

6. The drain flange cover of embodiment 4 or 5, wherein the magnet has the shape of a washer.

7. The drain flange cover of embodiment 1 or 4, further comprising a dome-shaped substructure having a size and shape typical of a cap on a drain stopper, wherein the dome-shaped substructure has a curved upper side that comprises the dome shape and an opposing underside, and wherein the sheet of material covers the upper side.

8. The article of manufacture of embodiment 4, wherein there is no shaft connected to the underside of the substructure that projects from underside.

9. A drain flange cover for covering a drain flange around a drain opening in a sink or bathtub, comprising:
   - a dome-shaped structure having an upper surface that has a curvature of a dome and an opposing lower surface, wherein the dome-shaped structure has a diameter of between one and three inches and is sized to cover and hide the drain flange; and
   - at least two standoffs that project from the lower surface of the dome-shaped structure that are designed and sized to rest on the drain flange and space the dome-shaped structure away from the drain flange so that water can flow out of the sink or bathtub between the lower surface of the dome-shaped structure and the drain flange around the stand-offs and into the drain opening.

10. The drain flange cover of embodiment 9, wherein the standoffs space the lower surface from the drain flange between 1/16 and 1/2 of an inch, and preferably wherein the standoffs include centering legs that extend away from the dome-shaped structure for centering the dome-shaped structure in the drain opening.

11. The drain flange cover of embodiment 9 or 10, further comprising glue or a magnet for each standoff for fastening the standoffs to the drain flange.

12. The drain flange cover of embodiment 9, 10 or 11, further comprising a sheet of material covering the upper surface of the dome-shaped structure.

13. The drain flange cover of embodiment 12, wherein the sheet of material is metallic and is bent to lap under the lower surface for fastening the sheet of material to the dome-shaped structure.

14. The drain flange cover of embodiment 12, wherein the sheet of material is metallic and is glued to the upper surface of the dome-shaped structure.

15. The drain flange cover of any one of embodiments 9-14, wherein there are four standoffs.

16. The drain flange cover of any one of embodiments 9-15, wherein the dome-shaped structure comprises a solid plastic article of manufacture.

17. The drain flange cover of any one of embodiments 9-15, wherein the dome-shaped structure comprises a plastic article of manufacture that is solid at the upper surface but has a web and hollow-cell structure at its lower surface.

18. The drain flange cover of any one of embodiments 9-15, wherein the dome-shaped structure comprises a web of material that defines a plurality of hollow cells.

19. A drain flange cover for covering a drain flange around a drain opening in a sink or bathtub that has a drain stopper in the drain opening, wherein the drain stopper has a cap that has a convex upper surface, the drain flange cover comprising:
   - a dome-shaped structure having a convex upper surface that has a curvature of a dome and an opposing concave lower surface that is sized and designed to mate with the convex upper surface of the cap on the drain stopper; and a magnet or glue in or on the concave lower surface for fastening the dome-shaped structure to the cap on the drain stopper.

20. The drain flange cover of embodiment 19, wherein the dome-shaped structure has a diameter of between one and three inches and is sized to cover and hide the drain flange.

21. The drain flange cover of embodiment 19 or 20, further comprising a sheet of a material covering the convex upper surface of the dome-shaped structure.

22. The drain flange cover of embodiment 21, wherein the sheet of a material laps under the dome-shaped structure.

23. The drain flange cover of embodiment 22, wherein the sheet of a material is crimped under the dome-shaped structure for fastening the sheet of material to the dome-shaped structure.

24. The drain flange cover of embodiment 22, wherein the sheet of a material is glued to the dome-shaped structure for fastening the sheet of material to the dome-shaped structure.

25. The article of manufacture or the drain flange cover of any one of embodiments 1-8, 12-14 or 21-24, wherein the sheet of material has a finish selected from the group consisting of polished chrome, brushed chrome, bronze, oil-rubbed bronze, polished bronze, brushed nickel, polished nickel, polished brass, satin brass, satin bronze, copper, matte black and white.

26. A drain flange cover for covering a drain flange around a drain opening in a sink or bathtub, comprising:

a dome-shaped structure having an upper surface that has a curvature of a dome and an opposing lower surface, wherein the dome-shaped structure is sized and designed to cover and hide the drain flange;

a shaft having an upper end attached to or formed integral with the dome-shaped structure and an opposing lower end, wherein the shaft projects perpendicular from the lower surface of the dome-shaped structure; and a disc attached to or formed integral with the lower end of the shaft, wherein the shaft projects perpendicular from the disc, and wherein the disc has a diameter that is slightly less than the diameter of the drain opening.

27. The drain flange of embodiment 26, further comprising a strainer basket surrounding the shaft between the dome-shaped structure and the disc.

28. The drain flange cover of embodiment 26 or 27, wherein the disc is circular, further comprising an O-ring around the circumference of the disc.

29. The drain flange cover of embodiment 26, 27 or 28, wherein the disc has an open structure that allows water to flow through the disc.

30. A drain flange cover for covering a drain flange around a drain opening in a sink or bathtub, comprising:

a dome-shaped structure having an upper surface that has a curvature of a dome and an opposing lower surface, wherein the dome-shaped structure is sized and designed to cover and hide the drain flange;

a shaft having an upper end attached to or formed integral with the dome-shaped structure and an opposing lower end, wherein the shaft projects perpendicular from the lower surface of the dome-shaped structure; and a strainer basket surrounding the shaft, wherein the strainer basket is fixed to the dome-shaped structure or the shaft or is removably attached to the dome-shaped structure or the shaft.

31. The drain flange cover of embodiment 30, wherein the strainer basket is sized to fit snugly in the drain opening.

32. A drain flange cover for covering a drain flange around a drain opening in a sink or bathtub, comprising:

a dome-shaped structure having an upper surface that has a curvature of a dome and an opposing lower surface, wherein the dome-shaped structure is sized and designed to cover and hide the drain flange;

a shaft having an upper end attached to or formed integral with the dome-shaped structure and an opposing lower end, wherein the shaft projects perpendicular from the lower surface of the dome-shaped structure; and a disc attached to or formed integral with the lower end of the shaft, wherein the shaft projects perpendicular from the disc, wherein the disc is circular and has a diameter that is slightly less than the diameter of the drain opening, and wherein the disc has openings through which water can pass and structural elements for screening hair and debris out of the water.

33. The drain flange cover of embodiment 32, further comprising an O-ring around the circumference of the disc.

34. The drain flange cover of embodiment 32, wherein the disc is sized and designed to seal against an inside wall of a pipe that defines the drain opening.

35. The drain flange cover of embodiment 32, 33 or 34, wherein the shaft is a tube having a perforated tube wall, wherein water can drain through the perforated tube wall, and wherein the perforated tube wall tends to screen hair and debris out of the water.

36. The drain flange cover of any one of embodiments 32-35, further comprising a sheet of a material covering the upper surface of the dome-shaped structure.

37. The drain flange cover of embodiment 36, wherein the sheet of material has a finish selected from the group consisting of polished chrome, brushed chrome, bronze, oil-rubbed bronze, polished bronze, brushed nickel, polished nickel, polished brass, satin brass, satin bronze, copper, matte black and white.

38. A drain flange cover for covering a drain flange around a drain opening in a sink or bathtub, comprising:

a dome-shaped structure having an upper surface that has a curvature of a dome and an opposing lower surface, wherein the dome-shaped structure is sized and designed to cover and hide the drain flange; and a screen having an upper end attached to or formed integral with the lower surface and an opposing lower end, wherein the screen has a longitudinal axis that is generally perpendicular to the lower surface of the dome-shaped structure, wherein the lower end of the screen has a diameter that is approximately equal to the diameter of the drain opening, wherein the upper end has a diameter that is substantially smaller than the diameter of the lower end, wherein the screen has openings through which water can pass and structural elements that define the openings, and wherein hair and debris in the water tends to be caught by the structural elements.

39. The drain flange cover of embodiment 38, wherein the screen has the shape of a cone.

40. The drain flange cover of embodiment 38, wherein the screen has a frustoconical shape.

41. The drain flange cover of embodiment 38, 39 or 40, wherein the screen is a wire mesh or a plastic mesh.

42. The drain flange cover of embodiment 38, 39 or 40, wherein the screen is a perforated sheet of material.

43. The drain flange cover of any one of embodiments 38-42, further comprising a disc attached to or formed integral with the lower end of the screen.

44. The drain flange cover of embodiment 43, wherein the disc is a wire mesh, a plastic mesh or a perforated sheet of material.

45. The drain flange cover of any one of embodiments 38-42, further comprising a ring attached to or formed integral with the lower end of the screen.

46. The drain flange cover of embodiment 43, 44 or 45, wherein the disc or the ring is sized and designed to fit tightly within an inside wall of a pipe that defines the drain opening.

47. The drain flange cover of embodiment 46, further comprising a seal around the perimeter of the disc or ring.

48. A drain flange cover and strainer for covering a drain flange around a drain opening in a sink or bathtub and for straining hair, debris and objects out of drain water, comprising:

a cap;

a tubular shaft having an upper end attached to or formed integral with the cap and an opposing lower end, wherein the tubular shaft projects perpendicular from the cap, and wherein the tubular shaft has openings sized and designed to filter out hair, debris and objects while allowing water to pass through the openings;

a gasket holder attached to or formed integral with the lower end of the shaft; and a gasket engaged with the gasket holder, wherein the gasket projects radially with respect to the longitudinal axis of the tubular shaft, and wherein the gasket is sized and designed to seal against an inside wall of a drain pipe.

49. The drain flange cover and strainer of embodiment 48, wherein the cap comprises a dome-shaped structure having an upper surface that has a curvature of a dome and an opposing lower surface, wherein the dome-shaped structure is sized and designed to cover and hide the drain flange.

50. The drain flange cover and strainer of embodiment 48 or 49, wherein the cap and the gasket each have a diameter, and wherein the diameter of the cap is greater than the diameter of the gasket, preferably wherein the diameter of the cap is at least 5, 10, 15 or 20% greater than the diameter of the gasket, more preferably wherein the diameter of the cap is at least 40% greater than the diameter of the gasket, and typically wherein the diameter of the cap is about 25% greater than the diameter of the gasket.

51. The drain flange cover and strainer of embodiment 48, 49 or 50, wherein the gasket holder is a flange that has a shape in cross-section similar to a wheel for holding an automobile tire.

52. The drain flange cover and strainer of any one of embodiments 48-51, wherein the cap comprises a dome-shaped structure having an upper surface that has a curvature of a dome and an opposing lower surface, and wherein the dome-shaped structure is sized and designed to cover and hide the drain flange, further comprising a sheet of a material covering the upper surface of the dome-shaped structure.

53. The drain flange cover and strainer of embodiment 52, wherein the gasket does not have holes or openings for intentionally allowing water to drain through the gasket, and wherein the gasket does not have notches about its outer perimeter.

54. The drain flange cover and strainer of embodiment 52, further comprising a plurality of standoffs on the underside or lower surface of the cap for spacing the cap away from the drain flange, and preferably further comprising centralizing fins or centering legs attached to the tubular shaft or to the cap for maintaining the tubular shaft in the center of the drain pipe.

55. The drain flange cover and strainer of embodiment 52, 53 or 54, wherein the sheet of material has a finish selected from the group consisting of polished chrome, brushed chrome, bronze, oil-rubbed bronze, polished bronze, brushed nickel, polished nickel, polished brass, satin brass, satin bronze, copper, matte black and white.

56. The drain flange cover and strainer of embodiment 55, wherein the tubular shaft has a circular cylindrical shape or a conical shape, preferably further comprising a plurality of standoffs on the underside of the cap for spacing the cap away from the drain flange so that water can flow under the cap and into the drain pipe, and preferably further comprising centralizing fins attached to the tubular shaft or centering legs attached to the underside of the cap for positioning the tubular shaft in approximately the center of the drain pipe, wherein the standoffs and the centralizing fins can be a combined plurality of spacer-centralizer elements.

57. The drain flange cover and strainer of any one of embodiments 48-56, wherein the cap and the tubular shaft are rigid.

58. A drain stopper for a bathtub or a sink having a drain opening and a drain pipe having a drain flange attached to the bathtub or the sink at the drain opening, comprising:

an open-close mechanism having a longitudinal axis and upper and lower ends, wherein the open-close mechanism is a push-push mechanism or a lift-and-lock mechanism or a lift-and-turn mechanism;

a cap engaged with the upper end of the open-close mechanism;

a seal engaged with the cap for providing a seal with the drain flange or the drain pipe;

a disk engaged with the lower end of the open-close mechanism;

a strainer surrounding the open-close mechanism, wherein the strainer rests on or is formed integral with or is attached to the disk, wherein the strainer has a plurality of openings through which water can flow, wherein an outer annular space is defined between the drain pipe and the strainer, wherein an inner space is defined in part by an inner surface of the strainer, wherein the disk does not have an opening through which water can drain from the outer annular space, and wherein the disk has one or more openings through which water can drain from the inner space, thereby forcing water to flow from the outside of the strainer to the inside of the strainer. Alternatively, the drain stopper does not include the strainer, or the strainer operates to catch hair, debris and objects inside the strainer.

59. The drain stopper of embodiment 58, wherein the cap has a diameter at its widest point, wherein the seal has a diameter at its widest point, and wherein the diameter of the cap is greater than the diameter of the seal.

60. The drain stopper of embodiment 58, wherein the disk has a perimeter that comprises a gasket for providing a seal against an inside surface of the drain pipe.

61. The drain stopper of embodiment 58, further comprising means for anchoring the open-close mechanism in the drain pipe, wherein the lower end of the open-close mechanism is engaged with the means for anchoring.

62. The drain stopper of embodiment 61, wherein the means for anchoring the open-close mechanism in the drain pipe is selected from the group consisting of:

male threads on the lower end of the push mechanism for threading into a tub shoe that has cross bars with an opening defined by female threads;

an anchor comprising a base and a set of prongs, wherein the base is in threaded engagement with the lower end of the open-close mechanism, and wherein the prongs have a catch mechanism for engaging a tub shoe that has cross bars; and the disk, wherein the disk is designed and sized for a friction engagement with an inside surface of the drain pipe.

63. The drain stopper of embodiment 58, wherein the drain stopper has a length, wherein the cap is in a threaded engagement with the open-close mechanism, and wherein the length can be adjusted by the amount of threaded engagement.

64. The drain stopper of embodiment 63, wherein the cap has a bore defined by female threads, wherein the upper end of the open-close mechanism has male threads that are received in the bore of the cap, further comprising a lock nut having female threads received on and in threaded engagement with the upper end of the open-close mechanism, wherein the lock nut can be moved into a tight friction abutment with the cap for holding the length of the drain stopper constant.

65. The drain stopper of embodiment 58, wherein the cap has a diameter at its widest point, wherein the seal has a diameter at its widest point, and wherein the diameter of the cap is 10 to 50 percent greater than the diameter of the seal.

66. The drain stopper of embodiment 12, wherein the disk has a perimeter that comprises a gasket for providing a seal against an inside surface of the drain pipe, wherein the gasket has a diameter at its widest point, wherein the cap has a diameter at its widest point, and wherein the diameter of the cap is at least 0.5 inch greater than the diameter of the gasket, preferably at least 1.0 inch greater.

67. The drain stopper of embodiment 58, wherein a two-prong fork is substituted for the disk on the lower end of the drain stopper for anchoring the drain stopper to a rod that protrudes into a drain pipe through a pivot rod port.

68. A drain flange cover and strainer for a sink or a bathtub that has a drain opening, wherein a drain pipe and a drain flange are sealed about the drain opening, the drain flange cover and strainer comprising:

a perforated tube that has a longitudinal axis and opposing upper and lower ends, wherein the perforated tube is generally cylindrical or generally conical in shape, wherein the perforated tube is rigid, and wherein the perforated tube functions as the strainer;

a cap attached directly or indirectly to the upper end, wherein the cap functions as the drain flange cover;

a flange received on the lower end, wherein the flange projects radially with respect to the longitudinal axis, and wherein the diameter of the cap is greater than the diameter of the flange; and a standoff for spacing the cap from the drain flange so that the drain flange cover cannot operate as a drain stopper.

69. The drain flange cover and strainer of embodiment 68, further comprising means for centralizing the perforated tube in the drain pipe.

70. The drain flange cover and strainer of embodiment 68 or 69, wherein the cap is sized and designed to cover and hide the drain flange, further comprising a plating or a sheet of a material covering the upper and outer surface of the cap, preferably wherein the plating or sheet of material has a finish selected from the group consisting of polished chrome, brushed chrome, bronze, oil-rubbed bronze, polished bronze, brushed nickel, polished nickel, polished brass, satin brass, satin bronze, copper, matte black and white, any color, an emblem, a character and a design.

71. A drain stopper and strainer, comprising: a cap; a seal engaged with the cap; a strainer having an upper end and an opposing lower end, wherein the upper end is formed integral with or attached to or engaged with the cap directly or indirectly, and wherein the strainer has a plurality of openings through which water can pass; and a longitudinally segmented cylinder or cone having a closed first end and an open and opposing second end, wherein the first end has at least one opening through which water can pass, wherein the longitudinally segmented cylinder or cone has at least two trough-shaped segments separated by longitudinal notches extending from the second end toward the first end, and wherein the first end is attached to or formed integral with the lower end of the strainer.

72. A drain stopper for a drain pipe having a drain flange, comprising: an open-close mechanism, preferably a push-push mechanism, having a length and opposing upper and lower ends; a cap engaged with the upper end of the push-close mechanism; a seal engaged with the cap for providing a seal with the drain flange; preferably, a strainer basket surrounding and engaged with the push-push mechanism; and an annular flange or two or more prongs extending radially outwardly from the strainer basket that are sized and designed to rest on the drain flange without interfering with the seal. No support is used within the drain pipe for holding the drain stopper because the prongs or the annular flange is used instead. The push-push mechanism can be inserted into and removed from the drain pipe without any assembly or disassembly, such as is required for removing a pivot rod to remove a drain stopper from a pop-up drain or such as for disengaging a bathtub drain stopper from a cross-bar.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A drain stopper and strainer, comprising: a cap; a seal engaged with the cap; a strainer having an upper end and an opposing lower end, wherein the upper end is formed integral with or attached to or engaged with the cap directly or indirectly, and wherein the strainer has a plurality of openings through which water can pass; and a longitudinally-segmented tube having a closed first end and an open and opposing second end, wherein the first end has at least one opening through which water can pass, wherein the longitudinally-segmented tube has at least two trough-shaped segments separated by longitudinal notches extending from the second end toward the first end, and wherein the first end is attached to or formed integral with the lower end of the strainer.

2. The drain stopper and strainer of claim 1, wherein the first end of and a portion of the longitudinally-segmented tube adjacent to the first end has the general shape of a bowl.

3. The drain stopper and strainer of claim 1, wherein the strainer has a tubular cylindrical or conical shape.

4. The drain stopper and strainer of claim 3, wherein the strainer has a tubular conical shape, wherein the upper and lower ends of the strainer have diameters, wherein the diameter of the lower end is greater than the diameter of the upper end of the strainer.

5. The drain stopper and strainer of claim 4, wherein the strainer has a wall that defines an internal space, wherein the wall has perforations that provide the plurality of openings in the strainer, and wherein water tends to flow through the perforations and into the internal space while in use.

6. The drain stopper and strainer of claim 5, wherein water in the internal space in the strainer tends to flow through the at least one opening in the first end of the longitudinally-segmented tube while in use.

7. The drain stopper and strainer of claim 1, wherein the longitudinally-segmented tube is a cylinder or a cone.

8. The drain stopper and strainer of claim 7, wherein the first end of the longitudinally segmented cylinder or cone has a perimeter and an annular portion adjacent to the perimeter, and wherein the lower end of the strainer is located within the annular portion of the first end of the longitudinally segmented cylinder or cone, and wherein the annular portion has a plurality of holes through which water can pass.

9. The drain stopper and strainer of claim 1, wherein the first end of and a portion of the longitudinally-segmented tube adjacent to the first end has the general shape of a bowl, wherein the strainer has a tubular cylindrical or conical shape, and wherein the longitudinally-segmented tube has three trough-shaped segments separated by longitudinal notches extending from the second end toward the first end.

10. The drain stopper and strainer of claim 1, wherein the first end of and a portion of the longitudinally-segmented tube adjacent to the first end has the general shape of a bowl, wherein the strainer has a conical shape, wherein the longitudinally-segmented tube has a slightly conical shape while not in use, wherein the first and second ends of the longitudinally-segmented tube have diameters, wherein the diameter of the second end is greater than the diameter of the first end while not in use, and wherein the longitudinally-segmented tube has three trough-shaped segments separated by longitudinal notches extending from the second end toward the first end.

11. The drain stopper and strainer of claim 1, wherein the second end of the longitudinally-segmented tube is curved inwardly so as to present a rounded edge.

12. The drain stopper and strainer of claim 1, wherein the first end of and a portion of the longitudinally-segmented tube adjacent to the first end has the general shape of an upside-down bowl while in use, and wherein the second end of the longitudinally-segmented tube is rounded or curved inwardly so as to present a rounded edge.

13. The drain stopper and strainer of claim 1, wherein the second end of the longitudinally-segmented tube has the appearance of two or more arcs arranged to form a segmented circle, wherein the longitudinally-segmented tube functions as a gripping element that a person can grip and that grips an inside wall of a drain pipe for holding the drain stopper and strainer in a position in which it is placed by the person, wherein the trough-shaped segments of the longitudinally-segmented tube define an interior space, further comprising a stiffening brace in the interior space along each edge of each notch.

14. A drain stopper and strainer, comprising: a cap; a seal engaged with the cap; a strainer attached directly or indirectly to the cap or formed integral with the cap; and a gripping element attached directly or indirectly to the strainer or formed integral with the strainer, wherein the gripping element is resilient so that a person can squeeze and compress the gripping element for placing the gripping element in a drain pipe after which the gripping element expands and grips the drain pipe, wherein the gripping element has one or more openings through which water can pass;

wherein the gripping element has an elongate cylindrical shape that is split longitudinally into at least two sections spaced apart that can be squeezed closer together.

15. The drain stopper and strainer of claim 14, wherein the gripping element is sized and designed to press against and grip an inside wall of a drain pipe, wherein a person can grasp the cap and slide the gripping element down to place the seal in a closed position and slide the gripping element up to place the seal in an open position.

16. The drain stopper and strainer of claim 15, wherein the gripping element is sized and designed to center the strainer in the drain pipe.

17. The drain stopper and strainer of claim 14, wherein the strainer is sized and designed to have an outside surface on which hair and debris tends to collect, and wherein the drain stopper and strainer can be pulled out of the drain pipe so that the hair and debris can be cleaned off of the strainer after which the drain stopper and strainer can be reinserted into the drain pipe.

18. The drain stopper and strainer of claim 17, wherein the strainer has a conical shape that is wider at an interface with the gripping element than at an interface with the cap.

19. A drain stopper and strainer, comprising: a cap; a seal engaged with the cap; a strainer attached directly or indirectly to the cap or formed integral with the cap; and a gripping element attached directly or indirectly to the strainer or formed integral with the strainer, wherein the gripping element is resilient so that a person can squeeze and compress the gripping element for placing the gripping element in a drain pipe after which the gripping element expands and grips the drain pipe, wherein the gripping element has one or more openings through which water can pass;

wherein the strainer is sized and designed to have an outside surface on which hair and debris tends to collect, and wherein the drain stopper and strainer can be pulled out of the drain pipe so that the hair and debris can be cleaned off of the strainer after which the drain stopper and strainer can be reinserted into the drain pipe; and wherein the strainer has a conical shape that is wider at an interface with the gripping element than at an interface with the cap.

* * * * *